US008265528B2

(12) United States Patent
Aratachi

(10) Patent No.: US 8,265,528 B2
(45) **Date of Patent: *Sep. 11, 2012**

(54) DEVELOPER ELECTRIC FIELD CONVEYER AND DEVELOPER FEEDER CONFIGURATION FOR AN IMAGE FORMING APPARATUS

(75) Inventor: Tomitake Aratachi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/843,340

(22) Filed: Jul. 26, 2010

(65) Prior Publication Data

US 2010/0290819 A1 Nov. 18, 2010

Related U.S. Application Data

(63) Continuation of application No. 12/365,680, filed on Feb. 4, 2009, now Pat. No. 7,792,471, which is a continuation of application No. PCT/JP2007/065567, filed on Aug. 2, 2007.

(30) Foreign Application Priority Data

Aug. 4, 2006 (JP) ..... 2006-212856

(51) Int. Cl.
*G03G 15/08* (2006.01)

(52) U.S. Cl. ..... 399/265; 399/266

(58) Field of Classification Search ..... 399/265, 399/266, 289

See application file for complete search history.

(56) References Cited

U.S. PATENT DOCUMENTS

| | | | |
|---|---|---|---|
| 4,598,991 | A | 7/1986 | Hosoya et al. |
| 5,323,214 | A | 6/1994 | Kai |
| 5,850,244 | A | 12/1998 | Leonard et al. |
| 6,934,496 | B2 | 8/2005 | Sakuma et al. |
| 2004/0037593 | A1 | 2/2004 | Sakuma et al. |

FOREIGN PATENT DOCUMENTS

| | | |
|---|---|---|
| JP | 63-013074 | 1/1988 |
| JP | 63-013078 | 1/1988 |

(Continued)

OTHER PUBLICATIONS

International Search Report received for PCT/JP2007/065567 dtd Sep. 25, 2007.

*Primary Examiner* — David Gray
*Assistant Examiner* — Laura Roth
(74) *Attorney, Agent, or Firm* — Banner & Witcoff, Ltd.

(57) ABSTRACT

A developing apparatus is accommodated within a laser printer. The developing apparatus includes a developing casing and a toner electric field transport body. The toner electric field transport body includes a transport wiring substrate and a transport-substrate support member. A plurality of transport electrodes are provided on the transport wiring substrate. The transport wiring substrate is supported by the transport-substrate support member in a state in which the transport wiring substrate is deformed in a tubular shape. In some examples, a tensile fixing means may fix the transport wiring substrate to the transport-substrate support member. Further, the transport wiring substrate is supported by the transport-substrate support member such that margin areas of the transport wiring substrate, which are opposite end portions of the transport wiring substrate with respect to a sub-scanning direction and in which the transport electrodes are not formed, are separated from a toner transport path.

15 Claims, 11 Drawing Sheets

FOREIGN PATENT DOCUMENTS

| | | |
|---|---|---|
| JP | 05-061336 | 3/1993 |
| JP | 05-031146 | 5/1993 |
| JP | 06-059568 | 3/1994 |
| JP | 2001-122436 | 5/2001 |
| JP | 2002-099143 | 4/2002 |
| JP | 2002-351218 | 12/2002 |
| JP | 2002-372850 | 12/2002 |
| JP | 2003-015417 | 1/2003 |
| JP | 2003-076137 | 3/2003 |
| JP | 2004-086040 | 3/2004 |
| JP | 2004-157259 | 6/2004 |
| JP | 2005-275127 | 10/2005 |

DEVELOPER ELECTRIC FIELD CONVEYER AND DEVELOPER FEEDER CONFIGURATION FOR AN IMAGE FORMING APPARATUS

CROSS REFERENCE TO RELATED APPLICATIONS

This application is a continuation of co-pending U.S. patent application Ser. No. 12/365,680, filed Feb. 4, 2009, which is a bypass continuation of International Application No. PCT/JP2007/065567 filed Aug. 2, 2007, which was published Under PCT Article 21(2), which claims priority to Japanese Application No. JP2006-212856, filed Aug. 4, 2006, the entire contents of which are incorporated herein by reference.

TECHNICAL FIELD

The present invention relates to a developer electric field transport apparatus, a developer supply apparatus, and an image forming apparatus.

BACKGROUND ART

Many mechanisms for transporting toner (developer) by means of traveling-wave electric fields (as disclosed in, for example, Japanese Patent Application Laid-Open (kokai) No. S63-13074, Japanese Patent Publication (kokoku) No. H5-31146, and Japanese Patent Application Laid-Open (kokai) Nos. 2002-351218, 2003-15417, 2004-157259, 2005-275127, etc.) are conventionally known for use in image forming apparatus. In such a mechanism, a large number of strip-shaped electrodes are juxtaposed in a row on an electrically insulative substrate.

In such a mechanism, polyphase AC voltages are sequentially applied to the plurality of strip-shaped electrodes, whereby traveling-wave electric fields are generated. By the action of the traveling-wave electric fields, the above-described toner in a charged state is transported in a predetermined direction.

DISCLOSURE OF THE INVENTION

In the above-described mechanism which can transport a charged developer by means of a traveling-wave electric field (hereinafter referred to as a "developer electric field transport apparatus"), an area in which the developer is not smoothly transported is formed on the above-described substrate in some cases. Such an area is mainly formed on portions of opposite ends of the substrate with respect to the direction along which the strip-shaped electrodes are arranged, in which portions the strip-shaped electrodes are not provided. In such an area, a traveling-wave electric field which can transport the developer well cannot be generated. Therefore, in that area, the developer cannot be transported well.

An object of the present invention is to provide a developer electric field transport apparatus which can smoothly transport a developer in a predetermined direction by means of a traveling-wave electric field, and a developer supply apparatus and an image forming apparatus which include the developer electric field transport apparatus.

(1) An image forming apparatus of the present invention comprises an electrostatic-latent-image carrying body and a developer supply apparatus.

The electrostatic-latent-image carrying body has a latent-image forming surface. The latent-image forming surface is formed in parallel with a predetermined main scanning direction, and configured such that an electrostatic latent image in the form of an electric potential distribution is formed thereon. The electrostatic-latent-image carrying body is configured such that the latent-image forming surface can move along a sub-scanning direction orthogonal to the main scanning direction.

The developer supply apparatus is disposed to face the electrostatic-latent-image carrying body. The developer supply apparatus is configured to supply a developer in the form of fine particles onto the latent-image forming surface in a state in which the developer is charged.

In the image forming apparatus of the present invention, the developer supply apparatus includes a developer containing casing, a plurality of transport electrodes, an insulating substrate, and a substrate support member.

The developer containing casing is a box-like member configured to be able to contain the developer therein. An opening portion is formed in the developer containing casing at a position facing the electrostatic-latent-image carrying body.

The transport electrodes are formed such that their longitudinal direction intersects with the sub-scanning direction. The plurality of transport electrodes are arranged along the sub-scanning directions. These transport electrodes are configured such that, when a traveling-wave voltage is applied to the transport electrodes, the transport electrodes can transport the developer in a predetermined developer transport direction.

The longitudinal direction may be set along the main scanning direction. For example, the longitudinal direction may be set in parallel with the main scanning direction. The developer transport direction may be set along the sub-scanning direction. For example, the developer transport direction may be set in parallel with the sub-scanning direction. Alternatively, the developer transport direction may be set such that the developer transport direction interests the sub-scanning direction with a small angle therebetween.

The insulating substrate is configured to have flexibility. The insulating substrate is accommodated within the developer containing casing such that a predetermined gap is formed between the insulating substrate and an inner wall surface of the developer containing casing. The transport electrodes are provided on the insulating substrate.

The substrate support member is accommodated within the developer containing casing. This substrate support member is configured to support the insulating substrate such that the insulating substrate is deformed in a tubular shape and the transport electrodes face the latent-image forming surface via the opening portion with a predetermined developing gap formed therebetween.

In the image forming apparatus of the present invention, the insulating substrate is supported by the substrate support member such that the transport electrodes face a developer transport path formed along the inner wall surface of the developer containing casing, and margin areas of the insulating substrate are separated from the developer transport path, wherein the margin areas are regions of end portions of the insulating substrate within respect to the sub-scanning direction (and the developer transport direction) in which regions the transport electrodes are not formed.

The image forming apparatus of the present invention having the above-described configuration operates as follows at the time of forming an image.

The electrostatic latent image in the form of an electric potential distribution is formed on the latent-image forming surface of the electrostatic-latent-image carrying body. The latent-image forming surface on which the electrostatic latent image is formed moves along the sub-scanning direction.

Meanwhile, a predetermined traveling-wave voltage is applied to the plurality of transport electrodes provided on the insulating substrate of the developer supply apparatus. Thus, a predetermined traveling-wave electric field is generated on the insulating substrate. By means of the traveling-wave electric field, the charged developer in the form of fine particles moves from an upstream end portion of the insulating substrate with respect to the developer transport direction to a downstream end portion of the insulating substrate with respect to the developer transport direction.

The insulating substrate is supported by the substrate support member in a state in which the insulating substrate is deformed in a tubular shape. Therefore, the upstream end portion of the insulating substrate with respect to the developer transport direction (at which transport of the developer starts) and the downstream end portion of the insulating substrate with respect to the developer transport direction (at which transport of the developer ends) face each other (generally in a state in which they are close to each other). Therefore, the developer is transported such that the developer moves around the insulating substrate and the substrate support member.

When the developer is supplied to the latent-image forming surface in the middle of transport of the developer, the developer adheres to the latent-image forming surface in accordance with the electrostatic latent image. That is, the electrostatic latent image is developed.

During such a developer transport operation, the above-described traveling-wave electric field is not generated in the margin areas. Therefore, the margin areas do not have a function of moving the developer along the developer transport direction.

In the image forming apparatus of the present invention, the margin areas are separated from the developer transport path. Thus, according to the image forming apparatus of the present invention, the margin areas are prevented, to a possible extent, from hindering transport of the developer along the developer transport path, which hindrance would otherwise occur because the margin areas face the developer transport path. Therefore, according to the image forming apparatus of the present invention, the developer can be smoothly transported in the developer transport direction by means of the traveling-wave electric field.

The image forming apparatus may further comprise a plurality of counter electrodes, and the insulating substrate may be supported by the substrate support member such that the margin areas are separated from the counter electrodes. The counter electrodes are supported on the inner wall surface of the developer containing casing. The counter electrodes are provided in parallel with the transport electrodes such that the counter electrodes face the transport electrodes with a predetermined gap formed therebetween.

In this case, the insulating substrate may be supported by the substrate support member such that the distance between the margin areas and the counter electrodes becomes greater than that between the transport electrodes and the counter electrodes.

In such a configuration, a predetermined traveling-wave voltage is applied to the plurality of transport electrodes, and a predetermined traveling-wave voltage is applied to the plurality of counter electrodes. As a result, a predetermined traveling-wave electric field is generated in the vicinity of the transport electrodes on the insulating substrate, and a predetermined traveling-wave electric field is generated in the vicinity of the counter electrodes. By means of these electric fields, the charged developer in the form of fine particles is caused to move on the developer transport path along the developer transport direction.

In such a configuration, the counter electrodes are provided at positions facing the margin areas, and the margin areas are separated from the counter electrodes. According to such a configuration, the developer is transported well by means of the counter electrodes in portions of the developer transport path, the portions corresponding to the margin areas of the insulating substrate in which the transport electrodes are not provided. Therefore, such a configuration enables smooth transport of the developer in a circulating state.

The image forming apparatus may further comprise electricity feed terminals, which may be provided in the margin areas of the insulating substrate. The electricity feed terminals are provided on the insulating substrate such that they can feed electricity to the transport electrodes.

By virtue of this configuration, supply of electricity to the plurality of transport electrodes provided on the insulating substrate and proper transport of the developer along the developer transport direction can be performed more reliably by a simple structure.

The insulating substrate may be engaged with the substrate support member in the margin areas.

By virtue of this configuration, the insulating substrate is reliably supported by the substrate support member in a predetermined manner.

In this case, the image forming apparatus may comprise a fixing member and a pulling engagement member.

The fixing member is configured to fix a first margin area of the insulating substrate, which is one part of the margin area at one end of the insulating substrate with respect to the sub-scanning direction (and the developer transport direction), to the substrate support member. The pulling engagement member configured to engage a second margin area of the insulating substrate, which is the other part of the margin area at the other end of the insulating substrate with respect to the sub-scanning direction (and the developer transport direction), with the substrate support member such that the pulling engagement member urges the second margin area in a direction for imparting a tension to the insulating substrate.

The pulling engagement member may be configured to urge opposite end portions of the second margin areas with respect to the main scanning direction so as to separate the opposite end portions from each other to the outside with respect to the main scanning direction.

The image forming apparatus may further comprise reinforcement members. The reinforcement members are provided in the margin areas, and are formed of the same material as the transport electrodes.

In such a configuration, the first margin area of the insulating substrate, which is one end portion of the insulating substrate with respect to the sub-scanning direction (and the developer transport direction) is fixed to the substrate support member. Further, the second margin area of the insulating substrate, which is the other end portion of the insulating substrate with respect to the sub-scanning direction (and the developer transport direction) is urged by the pulling engagement member such that a predetermined tension is applied to the insulating substrate. The second margin area is engaged with the substrate support member via the pulling engagement member.

By virtue of such a configuration, a portion of the insulating substrate where the transport electrodes are formed can be supported in a state in which that portion does not form a wrinkle and is smooth. Therefore, proper transport of the developer on the insulating substrate along the developer transport direction can be performed more reliably by a simple structure.

The substrate support member may include a tension imparting portion configured to impart a tension to the insulating substrate. That is, the substrate support member may be configured such that the substrate support member itself can impart a tension to the insulating substrate.

The substrate support member may include a first support member configured to support the first margin area and a second support member configured to support the second margin area, wherein the tension imparting portion is configured to urge the first support member and/or the second support member so as to separate the first support member and the second support member from each other.

In such a configuration, a predetermined tension is imparted to the insulating substrate as a result of the insulating substrate being supported by the substrate support member. Thus, the portion of the insulating substrate where the transport electrodes are formed can be supported in a state in which that portion does not form a wrinkle and is smooth. Therefore, proper transport of the developer on the insulating substrate along the developer transport direction can be performed more reliably by a simple structure.

(2) A developer supply apparatus of the present invention is configured to supply to a developer-image carrying body a developer in the form of fine particles in a charged state while transferring the developer along a predetermined developer transport direction.

The developer carrying body has a developer-image carrying surface. This developer-image carrying surface is a surface which can carry an image formed by the developer and which is parallel with a predetermined main scanning direction. The developer-image carrying surface can move along a sub-scanning direction orthogonal to the main scanning direction.

Specifically, for example, an electrostatic-latent-image carrying body having a latent-image forming surface configured such that an electrostatic latent image in the form of an electric-potential distribution can be formed on the surface can be used as the developer-image carrying body. Alternatively, for example, a recording medium (paper) transported along the sub-scanning direction can be used as the developer-image carrying body. Alternatively, for example, an intermediate transfer body configured and disposed such that the intermediate transfer body faces the recording medium and can transfer the developer onto the recording medium can be used as the developer-image carrying body.

The developer supply apparatus of the present invention comprises a developer containing casing, transfer electrodes, an insulating substrate, and a substrate support member.

The developer containing casing is a box-like member configured to be able to contain the developer therein. An opening portion is formed in the developer containing casing at a position facing the electrostatic-latent-image carrying body.

The transport electrodes are formed such that their longitudinal direction intersects with the sub-scanning direction. The plurality of transport electrodes are arranged along the sub-scanning directions. These transport electrodes are configured such that, when a traveling-wave voltage is applied to the transport electrodes, the transport electrodes can transport the developer in a predetermined developer transport direction.

The longitudinal direction may be set along the main scanning direction. For example, the longitudinal direction may be set in parallel with the main scanning direction. The developer transport direction may be set along the sub-scanning direction. For example, the developer transport direction may be set in parallel with the sub-scanning direction. Alternatively, the developer transport direction may be set such that the developer transport direction interests the sub-scanning direction with a small angle therebetween.

The insulating substrate is configured to have flexibility. The insulating substrate is accommodated within the developer containing casing such that a predetermined gap is formed between the insulating substrate and an inner wall surface of the developer containing casing. The transport electrodes are provided on the insulating substrate.

The substrate support member is accommodated within the developer containing casing. This substrate support member is configured to support the insulating substrate such that the insulating substrate is deformed in a tubular shape and the transport electrodes face the developer-image carrying surface via the opening portion with a predetermined developing gap formed therebetween.

In the developer supply apparatus of the present invention, the insulating substrate is supported by the substrate support member such that the transport electrodes face a developer transport path formed along the inner wall surface of the developer containing casing, and margin areas of the insulating substrate are separated from the developer transport path, wherein the margin areas are regions of end portions of the insulating substrate within respect to the sub-scanning direction in which regions the transport electrodes are not formed.

The developer supply apparatus of the present invention having the above-described configuration operates as follows at the time of forming an image.

A predetermined traveling-wave voltage is applied to the plurality of transport electrodes provided on the insulating substrate. Thus, a predetermined traveling-wave electric field is generated on the insulating substrate. By means of the traveling-wave electric field, the charged developer in the form of fine particles moves from an upstream end portion of the insulating substrate with respect to the developer transport direction to a downstream end portion of the insulating substrate with respect to the developer transport direction.

The insulating substrate is supported by the substrate support member in a state in which the insulating substrate is deformed in a tubular shape. Therefore, the upstream end portion of the insulating substrate with respect to the developer transport direction (at which transport of the developer starts) and the downstream end portion of the insulating substrate with respect to the developer transport direction (at which transport of the developer ends) face each other (generally in a state in which they are close to each other). Therefore, the developer is transported such that the developer moves around the insulating substrate and the substrate support member.

The developer is supplied to the developer-image carrying surface in the middle of transport of the developer. Thus, the developer adheres to the developer-image carrying surface, which is a surface of the developer-image carrying body, in a pattern corresponding to an image. That is, an image formed by the developer is carried on the developer-image carrying surface.

During such a developer transport operation, the above-described traveling-wave electric field is not generated in the margin areas. In the developer supply apparatus of the present invention, the margin areas are separated from the developer transport path.

Thus, according to the developer supply apparatus of the present invention, the margin areas are prevented, to a possible extent, from hindering transport of the developer along the developer transport path, which hindrance would otherwise occur because the margin areas face the developer transport path. Therefore, according to the developer supply apparatus of the present invention, the developer can be smoothly transported in the developer transport direction by means of the traveling-wave electric field.

The developer supply apparatus may further comprise a plurality of counter electrodes, and the insulating substrate may be supported by the substrate support member such that the margin areas are separated from the counter electrodes. The counter electrodes are supported on the inner wall surface of the developer containing casing. The counter electrodes are provided in parallel with the transport electrodes such that the counter electrodes face the transport electrodes with a predetermined gap formed therebetween.

In this case, the insulating substrate may be supported by the substrate support member such that the distance between the margin areas and the counter electrodes becomes greater than that between the transport electrodes and the counter electrodes.

In such a configuration, through application of predetermined voltages to the plurality of transport electrodes and to the plurality of counter electrodes, a predetermined traveling-wave electric field is generated in the vicinity of the transport electrodes on the insulating substrate, and a predetermined traveling-wave electric field is generated in the vicinity of the counter electrodes. By means of these electric fields, the charged developer in the form of fine particles is caused to move on the developer transport path along the developer transport direction.

In such a configuration, the counter electrodes are provided at positions facing the margin areas, and the margin areas are separated from the counter electrodes. According to such a configuration, the developer is transported well by means of the counter electrodes in portions of the developer transport path, the portions corresponding to the margin areas. Therefore, such a configuration enables smooth transport of the developer in a circulating state.

The developer supply apparatus may further comprise electricity feed terminals, which may be provided in the margin areas of the insulating substrate. The electricity feed terminals are provided on the insulating substrate such that they can feed electricity to the transport electrodes.

By virtue of this configuration, supply of electricity to the plurality of transport electrodes provided on the insulating substrate and proper transport of the developer along the developer transport direction can be performed more reliably by a simple structure.

The insulating substrate may be engaged with the substrate support member in the margin areas.

In this case, the developer supply apparatus may comprise a fixing member and a pulling engagement member.

The fixing member is configured to fix a first margin area of the insulating substrate, which is one part of the margin area at one end of the insulating substrate with respect to the sub-scanning direction, to the substrate support member. The pulling engagement member configured to engage a second margin area of the insulating substrate, which is the other part of the margin area at the other end of the insulating substrate with respect to the sub-scanning direction, with the substrate support member such that the pulling engagement member urges the second margin area in a direction for imparting a tension to the insulating substrate.

The pulling engagement member may be configured to urge opposite end portions of the second margin areas with respect to the main scanning direction so as to separate the opposite end portions from each other to the outside with respect to the main scanning direction.

The developer supply apparatus may further comprise reinforcement members. The reinforcement members are provided in the margin areas, and are formed of the same material as the transport electrodes.

In such a configuration, the first margin area, which is one end portion of the insulating substrate, is fixed to the substrate support member. Further, the second margin area, which is the other end portion of the insulating substrate, is urged by the pulling engagement member such that a predetermined tension is applied to the insulating substrate. The second margin area is engaged with the substrate support member via the pulling engagement member.

By virtue of such a configuration, the portion of the insulating substrate where the transport electrodes are formed can be supported in a state in which that portion does not form a wrinkle and is smooth. Therefore, proper transport of the developer on the insulating substrate along the developer transport direction can be performed more reliably by a simple structure.

The substrate support member may include a tension imparting portion configured to impart a tension to the insulating substrate. That is, the substrate support member may be configured such that the substrate support member itself can impart a tension to the insulating substrate.

The substrate support member may include a first support member configured to support the first margin area and a second support member configured to support the second margin area, wherein the tension imparting portion is configured to urge the first support member and/or the second support member so as to separate the first support member and the second support member from each other.

In such a configuration, a predetermined tension is imparted to the insulating substrate as a result of the insulating substrate being supported by the substrate support member. Thus, the portion of the insulating substrate where the transport electrodes are formed can be supported in a state in which that portion does not form a wrinkle and is smooth. Therefore, proper transport of the developer on the insulating substrate along the developer transport direction can be performed more reliably by a simple structure.

(3) A developer electric field transport apparatus of the present invention is configured to transport a charged developer in the form of fine particles along a predetermined developer transport direction by means of an electric field. This developer electric field transport apparatus is disposed to face a developer carrying body. The developer carrying body has a developer carrying surface. This developer carrying surface is a surface which can carry a thin layer of the developer and which is formed in parallel with a predetermined main scanning direction. The developer carrying surface can be moved along a predetermined moving direction. For example, the moving direction may be set to be parallel with a sub-scanning direction orthogonal to the main scanning direction.

Specifically, for example, an electrostatic-latent-image carrying body having a latent-image forming surface configured such that an electrostatic latent image in the form of an electric-potential distribution can be formed on the surface can be used as the developer carrying body. Alternatively, for example, a recording medium (paper) transported along the sub-scanning direction can be used as the developer-carrying body. Alternatively, for example, a roller, a sleeve, or a belt-like member (a developing roller, a developing sleeve, or the like) configured and disposed such that it faces the recording medium or the electrostatic-latent-image carrying body and can transfer the developer onto the recording medium or the electrostatic-latent-image carrying body can be used as the developer-image carrying body.

The developer electric field transport apparatus of the present invention comprises transfer electrodes, an insulating substrate, and a substrate support member.

The transport electrodes are formed such that their longitudinal direction intersects with the moving direction of the developer carrying surface. The plurality of transport electrodes are arranged along the moving direction. These transport electrodes are configured such that, when a traveling-wave voltage is applied to the transport electrodes, the transport electrodes can transport the developer in a predetermined developer transport direction.

The longitudinal direction may be set along the main scanning direction. For example, the longitudinal direction may be set in parallel with the main scanning direction. The developer transport direction may be set along the sub-scanning direction. For example, the developer transport direction may be set in parallel with the sub-scanning direction. Alternatively, the developer transport direction may be set such that the developer transport direction interests the sub-scanning direction with a small angle therebetween.

The insulating substrate is configured to have flexibility. The transport electrodes are provided on the insulating substrate.

The substrate support member is configured to support the insulating substrate such that the insulating substrate is deformed in a tubular shape.

In the developer electric field transport apparatus of the present invention, the margin areas of the insulating substrate, which are regions of end portions of the insulating substrate within respect to the moving direction in which regions the transport electrodes are not formed, are engaged with the substrate support member. Thus, the insulating substrate is supported by the substrate support member such that the margin areas are separated from a developer transport path formed along an area of the insulating substrate in which the transport electrodes are formed.

The developer electric field transport apparatus of the present invention having the above-described configuration operates as follows.

A predetermined voltage is applied to the plurality of transport electrodes provided on the insulating substrate. Thus, a predetermined traveling-wave electric field is generated on the insulating substrate. By means of the traveling-wave electric field, the charged developer in the form of fine particles moves from an upstream end portion of the insulating substrate with respect to the developer transport direction to a downstream end portion of the insulating substrate with respect to the developer transport direction.

The insulating substrate is supported by the substrate support member in a state in which the insulating substrate is deformed in a tubular shape. Therefore, the upstream end portion of the insulating substrate with respect to the developer transport direction (at which transport of the developer starts) and the downstream end portion of the insulating substrate with respect to the developer transport direction (at which transport of the developer ends) face each other (generally in a state in which they are close to each other). Therefore, the developer is transported such that the developer moves around the insulating substrate and the substrate support member.

The developer is supplied to the developer-image carrying surface in the middle of transport of the developer. That is, an image formed by the developer is carried on the developer-image carrying surface.

In the developer electric field transport apparatus of the present invention, the margin areas in which the above-described traveling-wave electric filed is not generated are separated from the developer transport path.

Thus, according to the developer electric field transport apparatus of the present invention, the margin areas are prevented, to a possible extent, from hindering transport of the developer along the developer transport path, which hindrance would otherwise occur because the margin areas face the developer transport path. Therefore, according to the developer electric field transport apparatus of the present invention, the developer can be smoothly transported in the developer transport direction by means of the traveling-wave electric field.

The insulating substrate may be engaged with the substrate support member in the margin areas. In this case, the developer electric field transport apparatus may comprise a fixing member and a pulling engagement member.

The fixing member is configured to fix a first margin area of the insulating substrate, which is one part of the margin area at one end of the insulating substrate with respect to the moving direction, to the substrate support member. The pulling engagement member configured to engage a second margin area of the insulating substrate, which is the other part of the margin area at the other end of the insulating substrate with respect to the moving direction, with the substrate support member such that the pulling engagement member urges the second margin area in a direction for imparting a tension to the insulating substrate.

The pulling engagement member may be configured to urge opposite end portions of the second margin areas with respect to the main scanning direction so as to separate the opposite end portions from each other to the outside with respect to the main scanning direction.

The developer electric field transport apparatus may further comprise reinforcement members. The reinforcement members are provided in the margin areas, and are formed of the same material as the transport electrodes.

In such a configuration, the first margin area, which is one end portion of the insulating substrate is fixed to the substrate support member. Further, the second margin area, which is the other end portion of the insulating substrate is urged by the pulling engagement member such that a predetermined tension is applied to the insulating substrate. The second margin area is engaged with the substrate support member via the pulling engagement member.

By virtue of such a configuration, the portion of the insulating substrate where the transport electrodes are formed can be supported in a state in which that portion does not form a wrinkle and is smooth. Therefore, proper transport of the developer on the insulating substrate along the developer transport direction can be performed more reliably by a simple structure.

The substrate support member may include a tension imparting portion configured to impart a tension to the insulating substrate. That is, the substrate support member may be configured such that the substrate support member itself can impart a tension to the insulating substrate.

The substrate support member may include a first support member configured to support the first margin area and a second support member configured to support the second margin area, wherein the tension imparting portion is configured to urge the first support member and/or the second support member so as to separate the first support member and the second support member from each other.

In such a configuration, a predetermined tension is imparted to the insulating substrate as a result of the insulating substrate being supported by the substrate support member. Thus, the portion of the insulating substrate where the transport electrodes are formed can be supported in a state in which that portion does not form a wrinkle and is smooth. Therefore, proper transport of the developer on the insulating substrate along the developer transport direction can be performed more reliably by a simple structure.

The developer electric field transport apparatus may further comprise electricity feed terminals, which may be provided in the margin areas of the insulating substrate. The electricity feed terminals are provided on the insulating substrate such that they can feed electricity to the transport electrodes.

By virtue of this configuration, supply of electricity to the plurality of transport electrodes provided on the insulating substrate and proper transport of the developer along the developer transport direction can be performed more reliably by a simple structure.

BEST MODE FOR CARRYING OUT THE INVENTION

Embodiments of the present invention (embodiments which the applicant contemplated as the best at the time of filing the present application) will next be described with reference to the drawings.

<Overall Configuration of Laser Printer>

Figure 1:
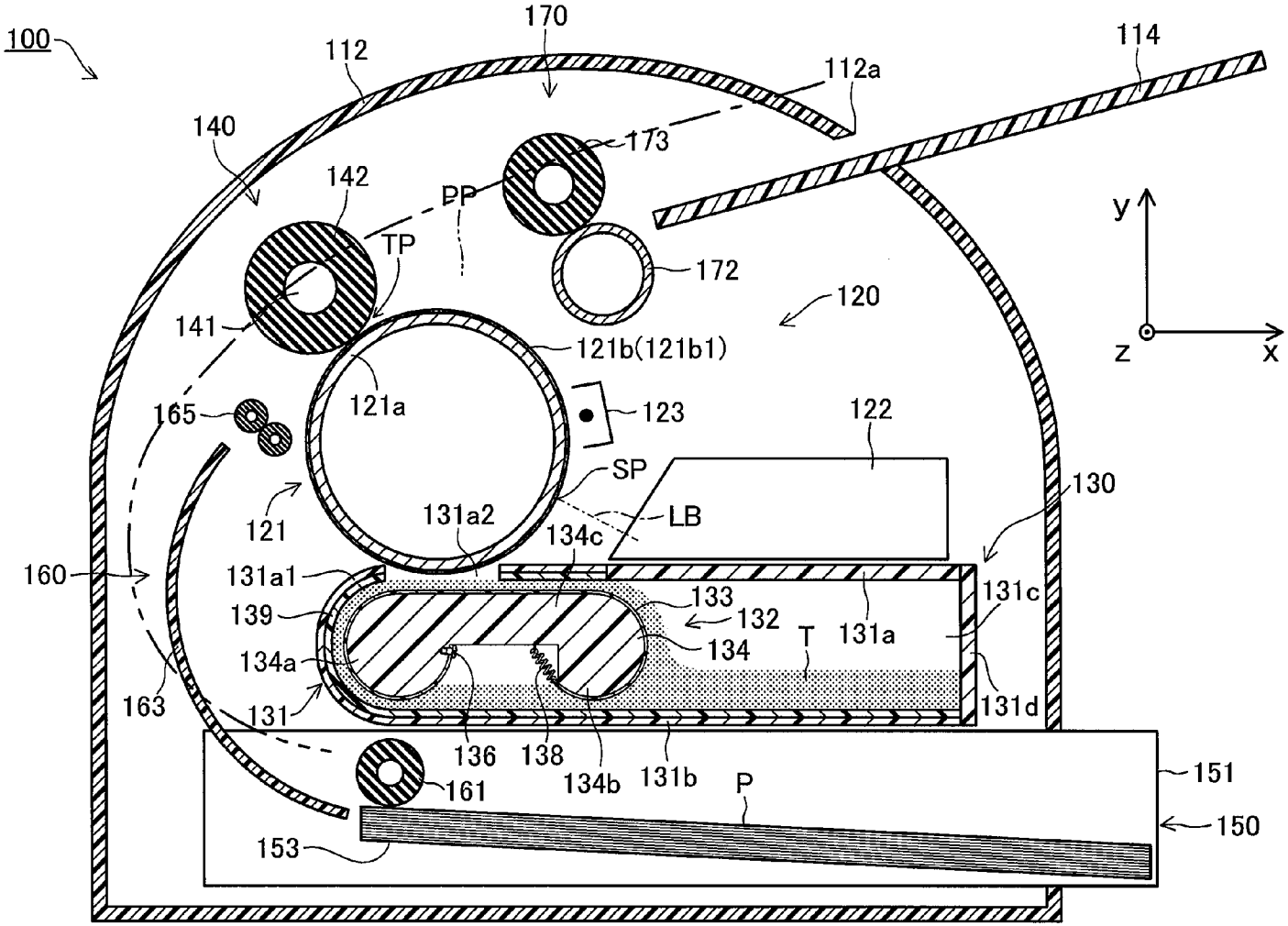
FIG. 1 is a side sectional view showing the schematic configuration of a laser printer to which one embodiment of the present invention is applied.

FIG. 1 is a side sectional view showing the schematic configuration of a laser printer 100 to which one embodiment of the present invention is applied.

In FIG. 1, the alternate-long-and-two-short-dashes line indicates a paper path PP along which a paper P is transported. The paper P serves as a recording medium on which an image is formed. A direction tangent to the paper path PP is called the paper transport direction. Further, an x-axis direction (left-right direction in FIG. 1) is called the front-rear direction. Further, for the sake of convenience, a side toward one end of the laser printer 100 (right side in FIG. 1) with respect to the front-rear direction is called the "front" side, and a side toward the other end of the laser printer 100 is called the "rear" side. Furthermore, a direction orthogonal to the paper transport direction and the front-rear direction is called the paper width direction (direction perpendicular to the sheet of FIG. 1).

<<Body Section>>

The laser printer 100, which corresponds to the image forming apparatus of the present invention, includes a body casing 112. The body casing 112 is an outer cover of the laser printer 100 and is integrally formed from a synthetic resin plate. The body casing 112 has a paper ejection port 112*a* in the form of a slit-like through-hole located at an upper front portion thereof.

A catch tray 114 is attached to an upper front portion of the body casing 112 at a position corresponding to the paper ejection port 112*a*. The catch tray 114 is configured to receive the paper P which is ejected through the paper ejection port 112*a* and on which an image has been formed.

<<Electrostatic-Latent-Image Forming Section>>

The body casing 112 houses an electrostatic-latent-image forming section 120. The electrostatic-latent-image forming section 120 includes a photoconductor drum 121, which corresponds to the electrostatic-latent-image carrying body, the developer-image carrying body, and the developer carrying body of the present invention.

The photoconductor drum 121 is a generally cylindrical member and is composed of a drum body 121*a* and a photoconductor layer 121*b*. The photoconductor drum 121 is disposed such that its center axis of rotation is in parallel with the paper width direction. The photoconductor drum 121 is configured to be able to be rotatably driven clockwise in FIG. 1.

The drum body 121*a* is a metal tube of an aluminum alloy or the like. The photoconductor layer 121*b* is a positively chargable photoconductive layer and is formed on the outer circumference of the drum body 121*a*.

The photoconductor layer 121*b* has an image carrying surface 121*b*1 formed on the circumferential surface thereof. The image carrying surface 121*b*1 corresponds to the latent-image forming surface, the developer-image carrying surface and the developer-carrying surface of the present invention. The image carrying surface 121*b*1 is configured such that an electrostatic latent image can be formed by electric-potential distribution (charge distribution). The image carrying surface 121*b*1 is formed in parallel with the center axis of rotation of the drum body 121*a* and a main scanning direction, which will be described later.

The electrostatic-latent-image forming section 120 includes a scanner unit 122 and a charger 123.

The scanner unit 122 is configured and disposed such that the image carrying surface 121*b*1 can be irradiated at a predetermined scanning position SP with a laser beam LB which has a predetermined wavelength, is modulated on the basis of image information, and is scanned along the main scanning direction (z-axis direction in FIG. 1) parallel with the paper width direction. The charger 123 is disposed upstream of the scanning position SP with respect to the direction of movement of the image carrying surface 121*b*1 (direction of rotation of the photoconductor drum 121). The charger 123 is configured and disposed so as to be able to uniformly, positively charge the image carrying surface 121*b*1 at a position located upstream of the scanning position SP with respect to the above-mentioned direction of movement.

The electrostatic-latent-image forming section 120 is configured such that the scanner unit 122 irradiates, with the laser beam LB, the image carrying surface 121*b*1 which is uniformly, positively charged by the charger 123, whereby an electrostatic latent image by electric-potential distribution can be formed on the image carrying surface 121*b*1. The electrostatic-latent-image forming section 120 is configured to be able to move the image carrying surface 121*b*1 on which an electrostatic latent image is formed, along the sub-scanning direction.

The "sub-scanning direction" is an arbitrary direction orthogonal to the main scanning direction. Usually, the sub-scanning direction is a direction which intersects with a vertical line. The sub-scanning direction is typically a direction along the front-rear direction (x-axis direction in FIG. 1).

<<Developing Device>>

The body casing 112 houses a developing device 130, which corresponds to the developer feed device of the present invention.

Figure 2:
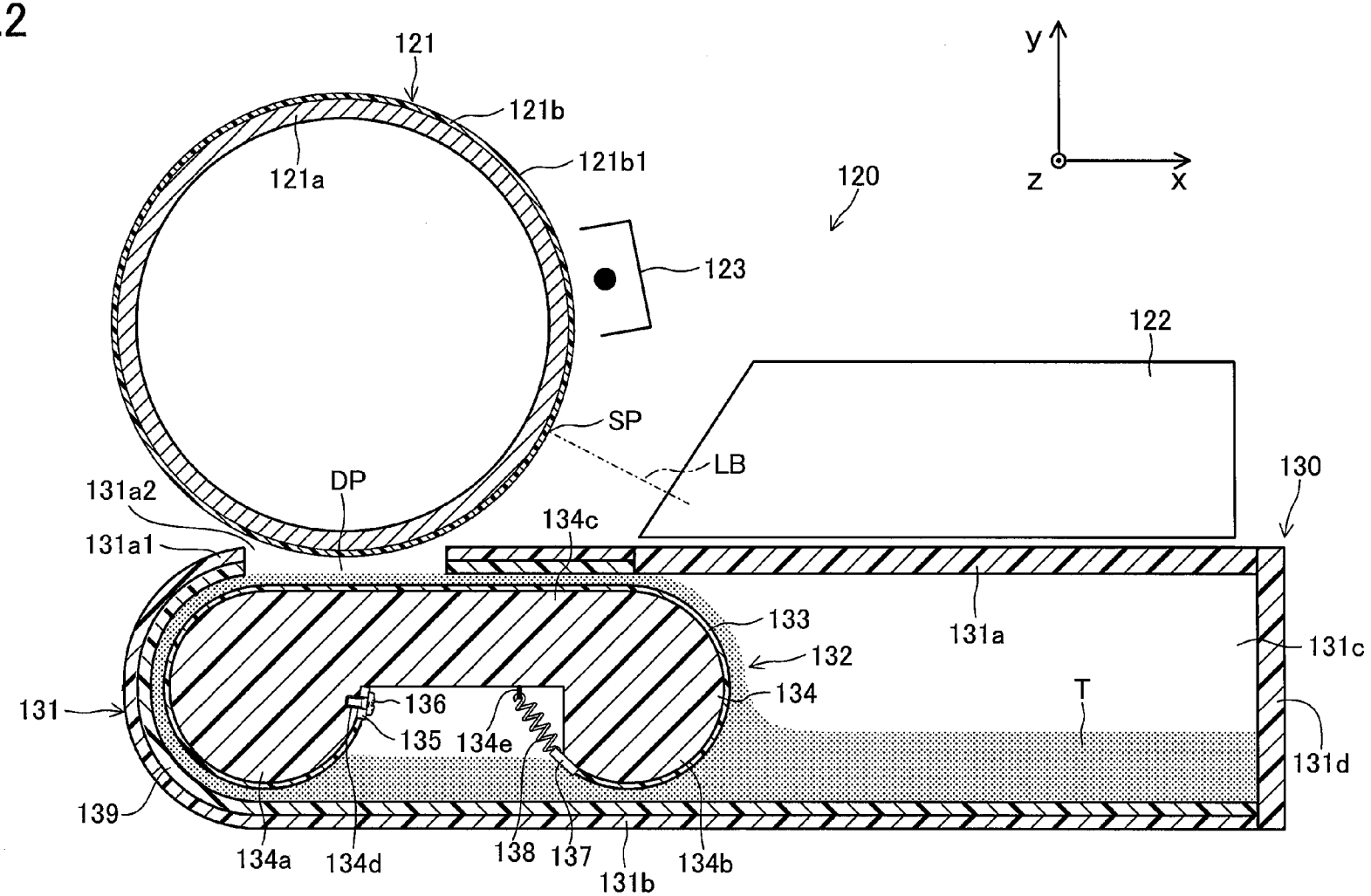
FIG. 2 is an enlarged side sectional view showing an electrostatic-latent-image forming section and a developing device shown in FIG. 1.

FIG. 2 is an enlarged side sectional view of the electrostatic-latent-image forming section 120 and the developing device 130 shown in FIG. 1.

Referring to FIGS. 1 and 2, the developing device 130 is disposed in such a manner as to face the photoconductor drum 121. That is, the developing device 130 is disposed below the photoconductor drum 121 in such a manner as to face the image carrying surface 121*b*1 at a position located downstream of the scanning position SP with respect to the direction of movement of the image carrying surface 121*b*1.

The developing device 130 is configured as described below so as to store a toner T, which is a developer in the form of fine particles, and supply the tonner T in a charged state to the image carrying surface 121*b*1 on which an electrostatic latent image is formed.

<<<Developing Casing>>>

Referring to FIGS. 1 and 2, a developing casing 131 is a box-like member and is configured to be able to contain the toner T therein. The developing casing 131 corresponds to the developer containing casing of the present invention.

A developing-section counter plate 131*a*1 is a rear portion of a casing top cover 131*a*, which serves as the ceiling of the developing casing 131. The developing-section counter plate 131*a*1 has a developing opening portion 131*a*2, which corresponds to the opening portion of the present invention. The developing opening portion 131*a*2 is provided in the developing-section counter plate 131*a*1 at a position facing the image carrying surface 121*b*1.

A casing bottom plate 131*b*, which serves as the bottom plate of the developing casing 131, and the developing-section counter plate 131*a*1 are formed integrally with each other in such a manner as to have a cross-sectional shape resembling the letter U at the rear end portion of the developing casing 131. A pair of casing side plates 131*c* are closingly attached to the opposite ends, with respect to the paper width direction, of the casing top cover 131*a* and to those of the casing bottom plate 131*b*. Also, a casing front blind plate 131*d* is closingly attached to the front end of the casing top cover 131*a*, to that of the casing bottom plate 131*b*, and to those of the paired casing side plates 131*c*.

<<<Developer Electric Field Transport Body>>>

Referring to FIGS. 1 and 2, the developing casing 131 houses a toner electric field transport body 132, which corresponds to the developer electric field transport body of the present invention.

The toner electric field transport body 132 is disposed in the inner space of the developing casing 131 at a rearward position, in such a manner as to face the image carrying surface 121*b*1 with the developing opening portion 131*a*2 therebetween. The opposite ends of the toner electric field transport body 132 are engaged with the paired casing side plates 131*c* as describe below. Thus, the toner electric field transport body 132 is supported at a position located above the casing bottom plate 131*b* while facing the developing-section counter plate 131*a*1 with a predetermined gap therebetween.

<<<<Transport Wiring Substrate>>>>

The toner electric field transport body 132 includes a transport wiring substrate 133. The transport wiring substrate 133 is disposed in such a manner as to face the image carrying surface 121*b*1 with the developing opening portion 131*a*2 therebetween.

Figure 3:
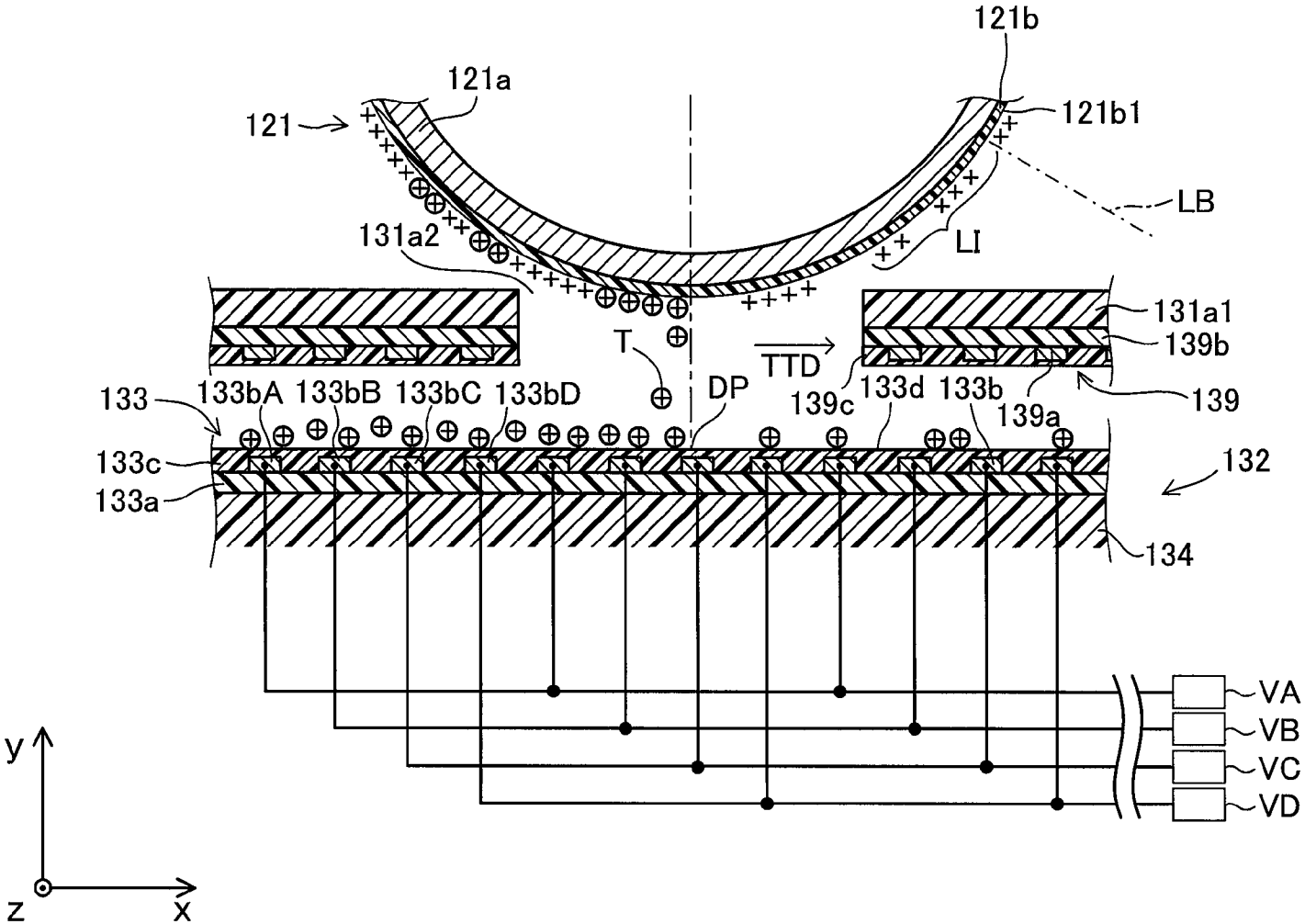
FIG. 3 is a side sectional view showing, on an enlarged scale, the vicinity of a developing position where the electrostatic-latent-image forming section and the developing device shown in FIG. 2 face each other.

FIG. 3 is a side sectional view showing, on an enlarged scale, the vicinity of a developing position DP, which is a position where the electrostatic-latent-image forming section 120 and the developing device 130 shown in FIG. 2 face each other with a smallest gap therebetween.

Referring to FIGS. 2 and 3, the transport wiring substrate 133 is formed of a printed wiring board having flexibility. The transport wiring substrate 133 is accommodated within the developing casing 131 such that a predetermined gap is formed between the transport wiring substrate 133 and a counter wiring substrate 139 to be described later, which is supported by an inner wall surface (a wall surface on the lower side in the drawings) of the casing top cover 131*a*.

Specifically, the transport wiring substrate 133 includes a transport-electrode support substrate 133*a*, transport electrodes 133*b*, and a transport-electrode coating layer 133*c*.

The transport-electrode support substrate 133*a*, which constitutes the insulating substrate of the present invention, is a flexible film formed of an insulating synthetic resin such as polyimide resin. The transport electrodes 133*b* are provided on the surface of the transport-electrode support substrate 133*a*.

The transport electrodes 133*b* are formed of copper film having a thickness of several tens of micrometers. The transport electrodes 133*b* are formed in a strip-like wiring pattern such that the longitudinal direction of the transport electrodes 133*b* is parallel with the above-mentioned main scanning direction (the z-axis direction in the drawings); i.e., perpendicular to the above-mentioned sub-scanning direction (the x-axis direction in the drawings). The transport electrodes 133*b* are disposed in parallel with each other and arranged along the sub-scanning direction. Each of the transport electrodes 133*b* is provided to face a toner transport path to be described later.

The transport electrodes 133*b* arrayed along the sub-scanning direction (in the x-axis direction in the drawings) are connected to power supply circuits such that every fourth transport electrode 133*b* is connected to the same power supply circuit. That is, the transport electrode 133*b*A connected to a power supply circuit VA, the transport electrode 133*b*B connected to a power supply circuit VB, the transport electrode 133*b*C connected to a power supply circuit VC, the transport electrode 133*b*D connected to a power supply circuit VD, the transport electrode 133*b*A connected to the power supply circuit VA, the transport electrode 133*b*B connected to the power supply circuit VB, . . . , are sequentially arrayed along the sub-scanning direction (the transport electrode 133*b*A refers to the transport electrode 133*b* connected to the power supply circuit VA. Similarly, the transport electrode 133*b*B refers to the transport electrode 133*b* connected to the power supply circuit VB. This rule applies to the transport electrode 133$b$C and the transport electrode 133$b$D as well).

Figure 4:
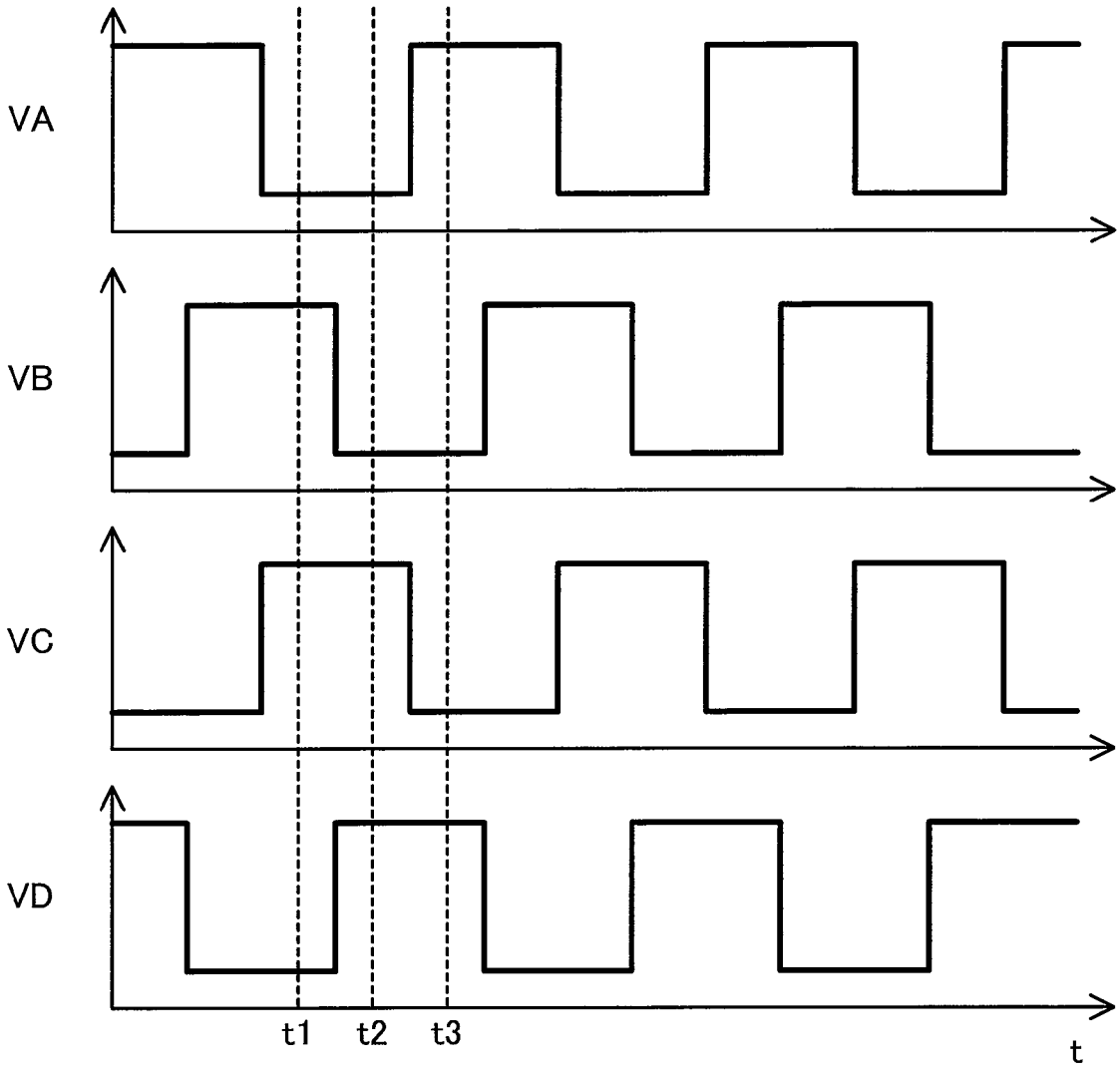
FIG. 4 is a set of graphs showing waveforms of voltages generated by power supply circuits shown in FIG. 3.

FIG. 4 is a set of graphs showing waveforms of voltages generated by the power supply circuits VA to VD shown in FIG. 3.

As shown in FIG. 4, the power supply circuits VA to VD are configured to generate AC voltages of substantially the same waveform. The waveforms of voltages generated by the power supply circuits VA to VD shift 90° in phase from one another. An unillustrated control circuit controls the power supply circuits VA to VD such that, in the sequence of the power supply circuits VA to VD, the phase of voltage delays in increments of 90°.

Referring to FIGS. 2 and 3, the toner electric field transport body 132 is configured to be able to transport the toner T as follows. Voltages as shown in FIG. 4 are applied to the transport electrodes 133$b$ of the transport wiring substrate 133, thereby generating traveling-wave electric fields along the toner transport direction TTD (developer transport direction) parallel with the sub-scanning direction. By this procedure, the positively charged toner T can be transported along the toner transport direction TTD.

The transport-electrode coating layer 133$c$ is provided on a surface of the transport-electrode support substrate 133$a$ on which the transport electrodes 133$b$ are formed.

The transport-electrode coating layer 133$c$ covers the transport-electrode support substrate 133$a$ and the transport electrodes 133$b$ to thereby make the toner transport surface 133$d$ smooth. The toner transport surface 133$d$ is a surface of the transport wiring substrate 133 which surface faces the image carrying surface 121$b$1 and is parallel with the main scanning direction. The transport electrodes 133$b$ are provided along the toner transport surface 133$d$.

In the present embodiment, the positional relation between the toner electric field transport body 132 and the photoconductive drum 121 is set such that the developing position DP is located at an approximate center of the developing opening portion 131$a$2 with respect to the sub-scanning direction. The toner electric field transport body 132 is disposed such that the toner transport surface 133$d$ faces the image carrying surface 121$b$1 of the photoconductive drum 121 via the developing opening portion 131$a$2 with the minimum gap formed therebetween at the developing position DP.

Figure 5:
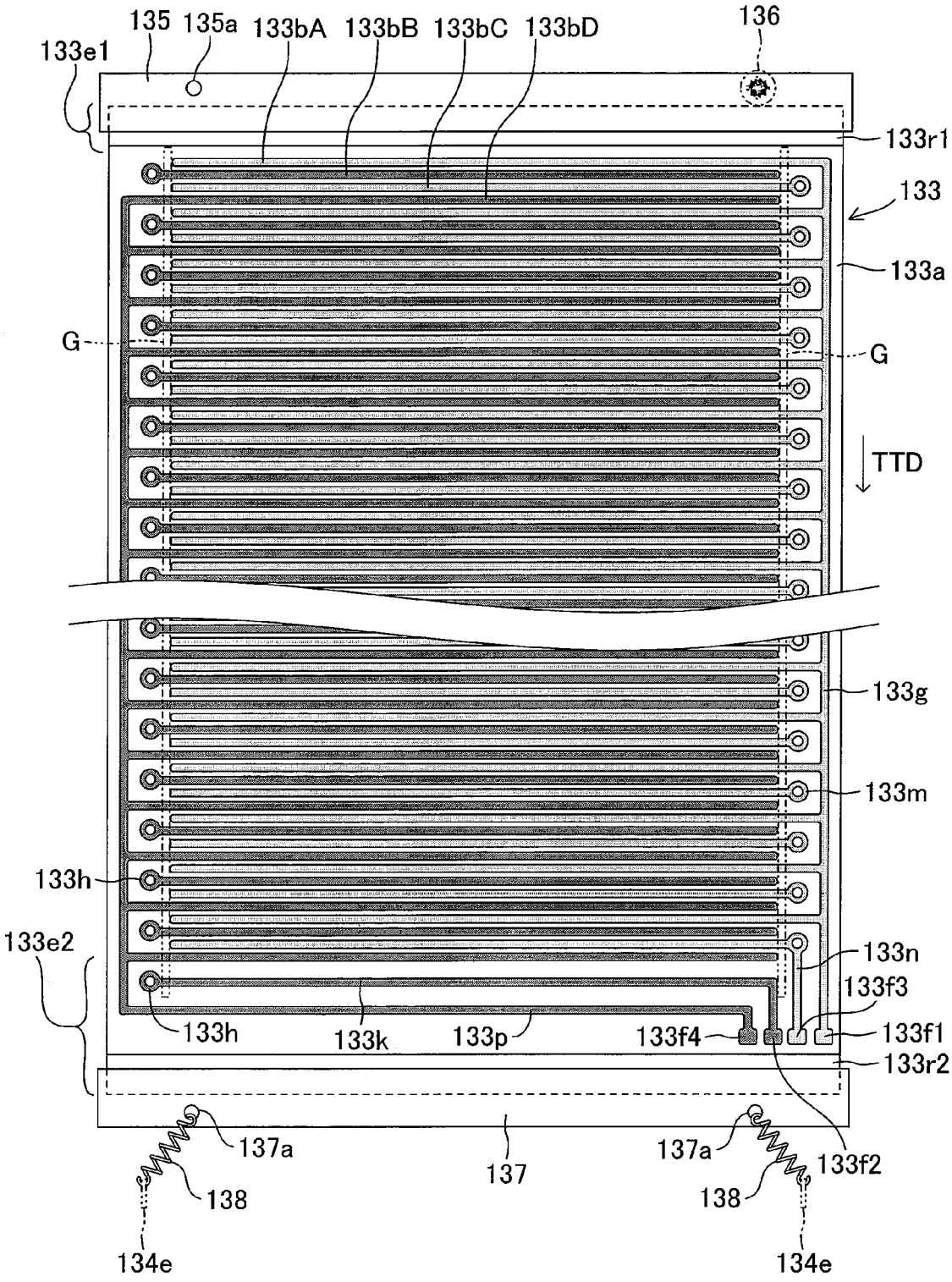
FIG. 5 is a plan view of a transport wiring substrate shown in FIG. 2.

FIG. 5 is a plan view of the transport wiring substrate 133 shown in FIG. 2.

Referring to FIG. 5, a first margin area 133$e$1, in which the transport electrodes 133$b$A, etc. are not provided, is formed at one end portion of the transport wiring substrate 133 with respect to the sub-scanning direction (an upper end portion thereof in FIG. 5; an upstream end portion thereof with respect to the toner transport direction TTD). Further, a second margin area 133$e$2, in which the transport electrodes 133$b$A, etc. are not provided, is formed at the other end portion of the transport wiring substrate 133 with respect to the sub-scanning direction (a lower end portion thereof in FIG. 5; a downstream end portion thereof with respect to the toner transport direction TTD).

A first electricity feed terminal 133$f$1, a second electricity feed terminal 133$f$2, a third electricity feed terminal 133$f$3, and a fourth electricity feed terminal 133$f$4 are provided in an upstream portion of the second margin area 133$e$2 with respect to the toner transport direction TTD. The first electricity feed terminal 133$f$1, the second electricity feed terminal 133$f$2, the third electricity feed terminal 133$f$3, and the fourth electricity feed terminal 133$f$4 are electrically connected to the power supply circuit VA, the power supply circuit VB, the power supply circuit VC, and the power supply circuit VD shown in FIG. 3.

Again referring to FIG. 5, the first electricity feed terminal 133$f$1 is connected to end portions (right-hand end portions in FIG. 5) of the transport electrodes 133$b$A via a first electricity feed wiring portion 133$g$. That is, the first electricity feed terminal 133$f$1, the plurality of transport electrodes 133$b$A, and the first electricity feed wiring portion 133$g$ are integrally formed as a wiring pattern of copper film. Electricity is fed to the plurality of transport electrodes 133$b$A via the first electricity feed terminal 133$f$1 and the first electricity feed wiring portion 133$g$.

A plurality of transport electrodes 133$b$B are connected to a second electricity feed wiring portion 133$k$ via through holes 133$h$ and an unillustrated inter-through-hole connection wining pattern formed on the back surface of the transport-electrode support substrate 133$a$. The second electricity feed terminal 133$f$2 is formed integrally with the second electricity feed wiring portion 133$k$ such that the second electricity feed terminal 133$f$2 is connected to an end portion of the second electricity feed wiring portion 133$k$ opposite the end portion thereof at which the through hole 133$h$ is formed. Electricity is fed to the plurality of transport electrodes 133$b$B via the second electricity feed terminal 133$f$2, the second electricity feed wiring portion 133$k$, and the through holes 133$h$.

Similarly, a plurality of transport electrodes 133$b$C are connected to a third electricity feed wiring portion 133$n$ via through holes 133$m$ and an unillustrated inter-through-hole connection wining pattern formed on the back surface of the transport-electrode support substrate 133$a$. The third electricity feed terminal 133$f$3 is formed integrally with the third electricity feed wiring portion 133$n$ such that the third electricity feed terminal 133$f$3 is connected to an end portion of the third electricity feed wiring portion 133$n$ opposite the end portion thereof at which the through hole 133$m$ is formed. Electricity is fed to the plurality of transport electrodes 133$b$C via the third electricity feed terminal 133$f$3, the third electricity feed wiring portion 133$n$, and the through holes 133$m$.

Further, the fourth electricity feed terminal 133$f$4 is connected to end portions (left-hand end portions in FIG. 5) of the transport electrodes 133$b$D via a fourth electricity feed wiring portion 133$p$. That is, the fourth electricity feed terminal 133$f$4, the plurality of transport electrodes 133$b$D, and the fourth electricity feed wiring portion 133$p$ are integrally formed as a wiring pattern of copper film. Electricity is fed to the plurality of transport electrodes 133$b$D via the fourth electricity feed terminal 133$f$4 and the fourth electricity feed wiring portion 133$p$.

In the first margin area 133$e$1, a first reinforcement member 133$r$1 formed of copper foil having a thickness of several tens of micrometers (which is identical with the transport electrodes 133$b$ in terms of material and thickness) is provided on both sides of the transport wiring substrate 133. In the second margin area 133$e$2, a second reinforcement member 133$r$2 formed of copper foil having a thickness of several tens of microns is provided on both sides of the transport wiring substrate 133. The first and second reinforcement members 133$r$1 and 133$r$2 reinforce opposite end portions of the transport wiring substrate 133 with respect to the sub-scanning direction.

<<<<Transport Substrate Support Member>>>>

Referring to FIG. 2, the toner electric field transport body 132 includes a transport-substrate support member 134. The transport-substrate support member 134 is accommodated within the developing casing 131.

The transport-substrate support member 134 is composed of an upstream support portion 134*a*, a downstream support portion 134*b*, and a connection portion 134*c*. The transport-substrate support member 134 is integrally formed of a synthetic resin.

The upstream support portion 134*a*, which corresponds to the first support member of the present invention, is a generally cylindrical member having a center axis parallel with the main scanning direction. The upstream support portion 134*a* is provided to face the photoconductive drum 121 at such a position that its center axis is located on the upstream side (left side in FIG. 2) of the developing position DP with respect to the toner transport direction.

The downstream support portion 134*b*, which corresponds to the second support member of the present invention, is a generally cylindrical member having a center axis parallel with the main scanning direction. The downstream support portion 134*b* is provided on the downstream side (right side in FIG. 2) of the photoconductive drum 121 with respect to the toner transport direction.

An upper end portion of the upstream support portion 134*a* and an upper end portion of the downstream support portion 134*b* are connected integrally and smoothly by the connection portion 134*c*, which is a generally flat member. The transport-substrate support member 134 is configured such that, as viewed in a side sectional view, a smooth surface is formed along a generally oval shape, the surface starting from a lower end portion of the upstream support portion 134*a*, passing through an upstream-side (left side in FIG. 2) end portion of the upstream support portion 134*a* with respect to the toner transport direction, an upper end portion of the upstream support portion 134*a*, an upper surface of the connection portion 134*c*, an upper end portion of the downstream support portion 134*b*, and a downstream-side (right side in FIG. 2) end portion of the downstream support portion 134*b* with respect to the toner transport direction, and reaching a lower end portion of the downstream support portion 134*b*.

The transport wiring substrate 133 is supported by the transport-substrate support member 134 such that the transport wiring substrate 133 deforms in a tubular shape and covers the outer circumference of the transport-substrate support member 134. Further, the transport-substrate support member 134 is configured and disposed such that the transport wiring substrate 133 faces the image carrying surface 121*b*1 of the photoconductive drum 121 via a predetermined developing gap (a region of the space within the developing opening portion 131*a*2 in the vicinity of the developing position DP).

As shown in FIG. 2, a toner transport path is formed by a smooth closed space located near the outside surface of the transport wiring substrate 133 and having an oval shape as viewed in a side sectional view, the space starting from the lower end portion of the upstream support portion 134*a* of the transport-substrate support member 134, passing through the upstream-side (left side in FIG. 2) end portion of the upstream support portion 134*a* with respect to the toner transport direction, the upper end portion of the upstream support portion 134*a*, the upper surface of the connection portion 134*c*, the upper end portion of the downstream support portion 134*b*, the downstream-side (right side in FIG. 2) end portion of the downstream support portion 134*b* with respect to the toner transport direction, and the lower end portion of the downstream support portion 134*b*, and reaching the lower end portion of the upstream support portion 134*a*.

A recess is formed below the connection portion 134*c* of the transport-substrate support member 134. The surfaces of the upstream support portion 134*a* and the downstream support portion 134*b* which surfaces face the recess are separated from the toner transport path.

Screw holes 134*d* are formed in an upper end portion of the surface of the upstream support portion 134*a* facing the recess. Further, engagement pieces 134*e* are provided on a lower portion of the connection portion 134*c* at a position near the downstream support portion 134*b* such that the engagement pieces 134*e* project downward in FIG. 2.

A one end portion (the first margin area 133*e*1 shown in FIG. 5) of the transport wiring substrate 133 with respect to the sub-scanning direction (and the toner transport direction) is fixed to the transport-substrate support member 134 via a plate-shaped fixing member 135.

That is, referring to FIG. 5, a portion of the upstream-side (upper side in FIG. 5) end portion of the transport wiring substrate 133 with respect to the toner transport direction TTD, where the first reinforcement member 133*r*1 is formed, is fixed to the fixing member 135. The fixing member 135 is configured such that its longitudinal direction becomes parallel with the above-mentioned paper width direction (the main scanning direction). Bolt through holes 135*a* are provided in opposite longitudinal end portions of the fixing member 135. The bolt through holes 135*a* are formed such that screw portions of fixing bolts 136 can be passed through the bolt through holes 135*a*.

As shown in FIGS. 2 and 5, the fixing member 135 is disposed such that the screw holes 134*d* and the bolt through holes 135*a* are aligned with each other, and the fixing bolts 136 are screwed into the screw holes 134*d*, whereby the first margin area 133*e*1 is fixed to the transport-substrate support member 134.

Referring to FIG. 5, a portion of the downstream-side (lower side in FIG. 5) end portion of the transport wiring substrate 133 with respect to the toner transport direction TTD, where the second reinforcement member 133*r*2 is formed, is fixed to a plate-shaped engagement portion 137. The engagement portion 137 is configured such that its longitudinal direction becomes parallel with the above-mentioned paper width direction (the main scanning direction).

Through holes 137*a* are formed in opposite longitudinal end portions of the engagement portion 137. First ends of pulling engagement members 138, each formed of a coil spring, are engaged with the through holes 137*a*. Second ends of the pulling engagement members 138 are engaged with the engagement pieces 134*e*.

As shown in FIG. 5, the through holes 137*a* are provided at positions inward of the engagement pieces 134*e* with respect to the paper width direction (the main scanning direction). That is, the engagement pieces 134*e*, the through holes 137*a*, and the pulling engagement members 138 are configured and disposed such that the pulling engagement members 138 urge the opposite end portions of the second margin area 133*e*2 with respect to the paper width direction (the main scanning direction) such that they are separated outward from each other, and a predetermined tension is applied to the transport wiring substrate 133.

Referring to FIG. 2, the fixing member 135 is fixed by means of the fixing bolts 136 at positions corresponding to the screw holes 134*d* of the upstream support portion 134*a*, and the engagement portion 137 are engaged with the engagement pieces 134*e* by means of the pulling engagement members 138. Thus, the transport-substrate support member 134 supports the transport wiring substrate 133 such that a predetermined tension is applied to the transport wiring substrate 133.

That is, as shown in FIGS. 2 and 5, the transport wiring substrate 133 is engaged with the transport-substrate support member 134 in such a manner that the first margin area 133*e*1 and the second margin area 133*e*2 are separated from the toner transport path (and the counter wiring substrate 139 to be described later).

Further, the transport-substrate support member 134 supports the transport wiring substrate 133 such that the distance between the first margin area 133*e*1 and the second margin area 133*e*2 and the counter wiring substrate 139 becomes greater than that between the transport wiring substrate 133 and the counter wiring substrate 139.

<<<<Counter Wiring Substrate>>>>

Referring to FIGS. 1 and 2, the above-described counter wiring substrate 139 is supported on the inner wall surfaces of the developing-section counter plate 131*a*1 and on that of the casing bottom plate 131*b*. In the present embodiment, the counter wiring substrate 139 is provided along substantially the entire length of the casing bottom plate 131*b* along the front-rear direction.

The counter wiring substrate 139 has a configuration similar to that of the above-described transport wiring substrate 133. That is, referring to FIG. 3, the counter wiring substrate 139 includes a plurality of counter electrodes 139*a*, a counter-electrode support substrate 139*b*, and a counter-electrode coating layer 139*c*.

Specifically, similar to the transport electrodes 133*b*, the counter electrodes 139*a* have their longitudinal direction along the main scanning direction orthogonal to the sub-scanning direction. The plurality of counter electrodes 139*a* are disposed in parallel with one another. Furthermore, the plurality of counter electrodes 139*a* are arrayed along the sub-scanning direction. That is, the counter electrodes 139*a* are provided in parallel with the transport electrodes 133*b* such that the counter electrodes 139*a* face the transport electrodes 133*b* via a predetermined gap (the above-described toner transport path).

As in the case of the above-described transport wiring substrate 133, the counter wiring substrate 139 is configured to be able to transport the toner T as follows. Predetermined voltages are applied to the plurality of counter electrodes 139*a*, thereby generating traveling-wave electric fields along the toner transport direction TTD parallel with the sub-scanning direction. By this procedure, the positively charged toner T can be transported along the toner transport direction TTD.

<<Transfer Section>>

Referring again to FIG. 1, a transfer section 140 is provided in such a manner as to face the image carrying surface 121*b*1 at a position located downstream, with respect to the direction of rotation of the photoconductor drum 121, of the position where the photoconductor drum 121 and the developing device 130 face each other.

The transfer section 140 includes a rotary center shaft 141, which is a roller-like member and is made of metal, and a conductive rubber layer 142, which is circumferentially provided on the rotary center shaft 141. The rotary center shaft 141 is disposed in parallel with the main scanning direction. A high-voltage power supply is connected to the rotary center shaft 141. The conductive rubber layer 142 is formed of a synthetic rubber containing conductive particles, such as carbon black, kneadingly mixed thereinto, so that the conductive rubber layer 142 becomes electrically conductive or semiconductive.

The transfer section 140 is configured to be able to transfer the toner T from the image carrying surface 121*b*1 to the paper P by means of being rotatably driven counterclockwise while a predetermined transfer voltage is applied between the transfer section 140 and the drum body 121*a* of the photoconductor drum 121.

<<Paper Feed Cassette>>

A paper feed cassette 150 is disposed under the developing device 130. A paper feed cassette case 151 is a box-like member used to form the casing of the paper feed cassette 150 and opens upward. The paper feed cassette case 151 is configured to be able to contain a large number of sheets of the paper P of up to size A4 (210 mm width×297 mm length) in a stacked state.

A paper-pressing plate 153 is disposed within the paper feed cassette case 151. The paper-pressing plate 153 is supported by the paper feed cassette case 151 in such a manner as to pivotally move on a pivot at its front end portion, so that its rear end can move vertically in FIG. 1. An unillustrated spring urges the rear end portion of the paper-pressing plate 153 upward.

<<Paper Transport Section>>

A paper transport section 160 is housed within the body casing 112. The paper transport section 160 is configured to be able to feed the paper P to a paper transfer position TP where the transfer section 140 and the image carrying surface 121*b*1 face each other with a smallest gap therebetween. The paper transport section 160 includes a paper feed roller 161, a paper guide 163, and paper transport guide rollers 165.

The paper feed roller 161 includes a rotary center shaft parallel with the main scanning direction and a rubber layer, which is circumferentially provided on the rotary center shaft. The paper feed roller 161 is disposed in such a manner as to face a leading end portion, with respect to the paper transport direction, of the paper P stacked on the paper-pressing plate 153 housed within the paper feed cassette case 151. The paper guide 163 and the paper transport guide rollers 165 are configured to be able to guide to the transfer position TP the paper P which has been delivered by the paper feed roller 161.

<<Fixing Section>>

A fixing section 170 is housed within the body casing 112. The fixing section 170 is disposed downstream of the transfer position TP with respect to the paper transport direction. The fixing section 170 is configured to apply pressure and heat to the paper P which has passed the transfer position TP and bears an image in the toner T, thereby fixing the image in the toner T on the paper P. The fixing section 170 includes a heating roller 172 and a pressure roller 173.

The heating roller 172 includes a cylinder which is made of metal and whose surface is exfoliation-treated, and a halogen lamp which is housed within the cylinder. The pressure roller 173 includes a rotary center shaft which is made of metal, and a silicone rubber layer which is circumferentially provided on the rotary center shaft. The heating roller 172 and the pressure roller 173 are disposed in such a manner as to press against each other under a predetermined pressure.

The heating roller 172 and the pressure roller 173 are configured and disposed so as to be able to deliver the paper P toward the paper ejection port 112*a* while applying pressure and heat to the paper P.

<Outline of Image Forming Operation of Laser Printer>

The outline of an image forming operation of the laser printer 100 having the above-described configuration will next be described with reference to the drawings.

<<Paper Feed Operation>>

Referring to FIG. 1, the paper-pressing plate 153 urges the paper P stacked thereon upward toward the paper feed roller 161. This causes the top paper P of a stack of the paper P on the paper-pressing plate 153 to come into contact with the circumferential surface of the paper feed roller 161. When the paper feed roller 161 is rotatably driven clockwise in FIG. 1, a leading end portion with respect to the paper transport direction of the top paper P is moved toward the paper guide 163. Then, the paper guide 163 and the paper transport guide rollers 165 transport the paper P to the transfer position TP.

<<Formation of Toner Image on Image Carrying Surface>>

While the paper P is being transported to the transfer position TP as described above, an image in the toner T is formed as described below on the image carrying surface 121*b*1, which is the circumferential surface of the photoconductor drum 121.

<<<Formation of Electrostatic Latent Image>>>

First, the charger 123 uniformly charges a portion of the image carrying surface 121*b*1 of the photoconductor drum 121 to positive polarity.

Referring to FIG. 3, as a result of the clockwise rotation of the photoconductor drum 121, the portion of the image carrying surface 121*b*1 which has been charged by the charger 123 moves along the sub-scanning direction to the scanning position SP, where the portion of the image carrying surface 121*b*1 faces (faces straight toward) the scanner unit 122. At the scanning position SP, the charged portion of the image carrying surface 121*b*1 is irradiated with the laser beam LB modulated on the basis of image information, while the laser beam LB sweeps along the main scanning direction. Certain positive charges are lost from the charged portion of the image carrying surface 121*b*1, according to a state of modulation of the laser beam LB. By this procedure, an electrostatic latent image LI in the form of an imagewise distribution of positive charges is formed on the image carrying surface 121*b*1.

As a result of the clockwise rotation of the photoconductor drum 121 in FIG. 3, the electrostatic latent image LI formed on the image carrying surface 121*b*1 moves toward the developing position DP.

<<<Transport of Charged Toner>>>

Referring to FIG. 2, predetermined voltages (similar to those shown in FIG. 4) are applied to the counter wiring substrate 139, thereby forming predetermined traveling-wave electric fields on the counter wiring substrate 139. By means of the electric fields, the toner T which resides on the bottom of the inner space of the developing casing 131, is transported rearward (leftward in FIG. 2) on the counter wiring substrate 139 supported on the casing bottom plate 131*b*. The toner T is transported to the rear end of the inner space of the developing casing 131; more specifically, to a position where the transport wiring substrate 133 and the counter wiring substrate 139 face each other.

The toner T residing between the transport wiring substrate 133 and the counter wiring substrate 139 is transported toward the developing position DP by the effect of traveling-wave electric fields generated on the transport wiring substrate 133 and on the counter wiring substrate 139.

A toner-T-transporting motion effected by the counter wiring substrate 139 is similar to that effected by the transport wiring substrate 133. Thus, the toner-T-transporting motion effected by the transport wiring substrate 133 will be described below in detail.

Figure 6:
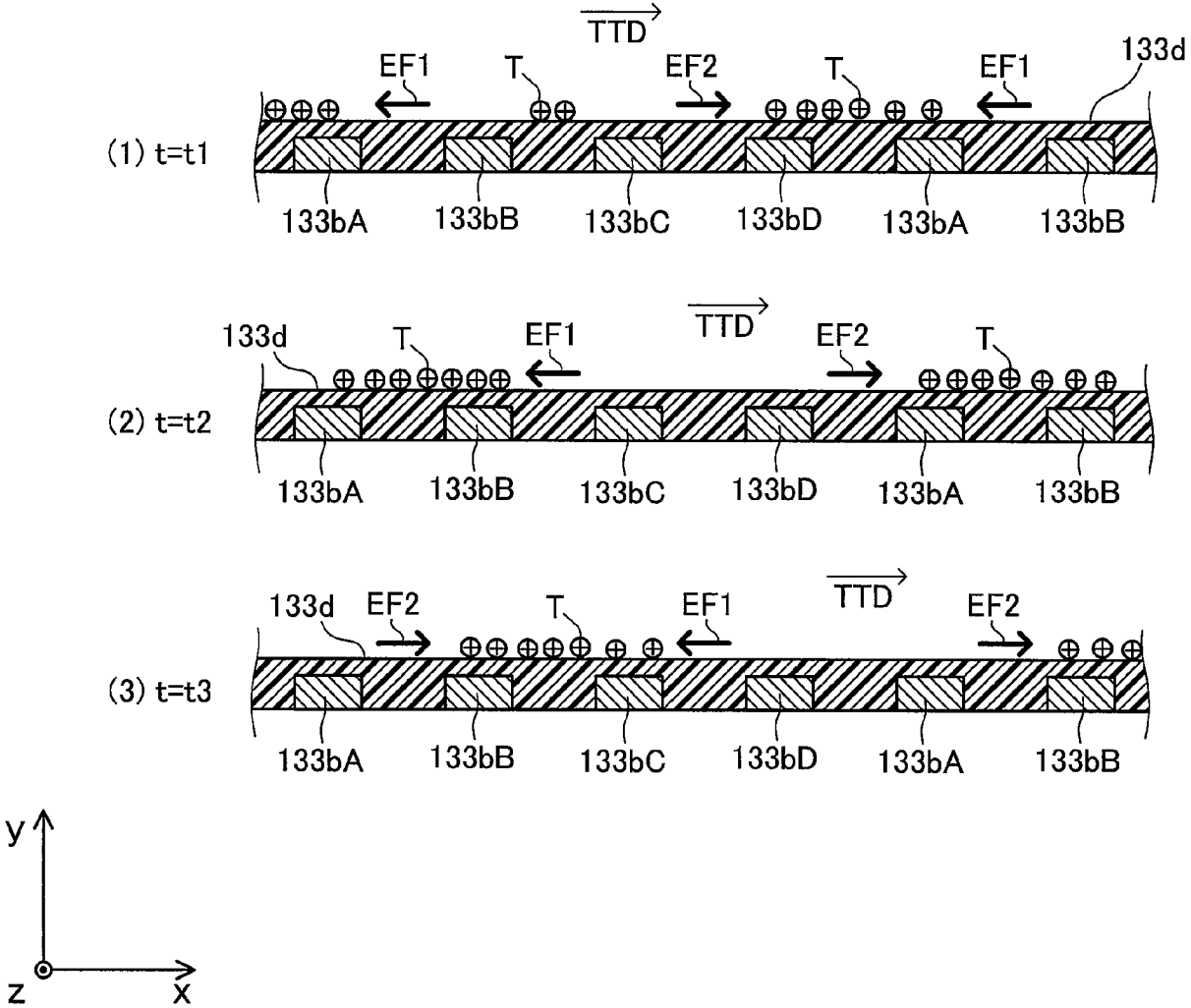
FIG. 6 is a set of side sectional view showing, on an enlarged scale, the vicinity of a developer transport surface of the transport wiring substrate shown in FIG. 3.

FIG. 6 is a side sectional view showing, on an enlarged scale, the toner transport surface 133*d* of the transport wiring substrate 133 shown in FIG. 3, and its periphery.

Referring to FIGS. 4 and 6, at time t1 in FIG. 4, an electric field EF1 directed opposite the toner transport direction TTD (directed opposite the x direction in FIG. 6) is formed in a section AB between the transport electrode 133*b*A and the transport electrode 133*b*B. Meanwhile, an electric field EF2 directed in the toner transport direction TTD (x direction in FIG. 6) is formed in a section CD between the transport electrode 133*b*C and the transport electrode 133*b*D. No electric field directed along the toner transport direction TTD is formed in a BC section between the transport electrode 133*b*B and the transport electrode 133*b*C and in a DA section between the transport electrode 133*b*D and the transport electrode 133*b*A.

That is, at time t1, the positively charged toner T in the sections AB is subjected to electrostatic force directed opposite the toner transport direction TTD. The positively charged toner T in the sections BC and DA is hardly subjected to electrostatic force directed along the toner transport direction TTD. The positively charged toner T in the CD sections is subjected to electrostatic force directed in the toner transport direction TTD. Thus, at time t1, the positively charged toner T is collected in the DA sections.

Similarly, at time t2, the positively charged toner T is collected in the sections AB. When time t3 is reached, the positively charged toner T is collected in the sections BC. In this manner, areas where the toner T is collected move with time in the toner transport direction TTD along the toner transport surface 133*d*.

As described above, as result of application of voltages as shown FIG. 4 to the transport electrodes 133*b*, traveling-wave electric fields are formed on the toner transport surfaces 133*d*. Thus, the toner T is transported in the toner transport direction TTD (x-direction in FIG. 6) while hopping in the y-direction in FIG. 6.

Referring to FIG. 2, the toner T is transported along the outer circumference of the upstream support portion 134*a* by means of the above-described traveling-wave electric fields generated on the transport wiring substrate 133 and the counter wiring substrate 139, whereby the toner T is transported toward the developing position DP from a position where the transport wiring substrate 133 and the counter wiring substrate 139 face each other at the most upstream side with respect to the toner transport direction; i.e., a position along the toner transport path corresponding to the lower end portion of the upstream support portion 134*a*.

At a portion of the toner transport path corresponding to the developing opening portion 131*a*2, the counter wiring substrate 139 is not formed. Therefore, at that portion, the toner T is supplied (transported) to the developing position DP by means of the traveling-wave electric field generated on the transport wiring substrate 133.

A portion of the toner T, which portion was supplied to the developing position DP but not used for development of an electrostatic latent image, is transported from the developing position DP to a position along the toner transport path corresponding to the upper end portion of the downstream support portion 134*b*. A portion of the toner T having passed through a position along the toner transport path corresponding to the front side (right side in FIG. 2) end portion of the downstream support portion 134*b* falls down toward the casing bottom plate 131*b* because of gravity, and the remaining portion moves on the transport wiring substrate 133 to a position corresponding to the lower end portion of the downstream support portion 134*b*.

The toner T is transported, by the traveling-wave electric field generated on the counter wiring substrate 139, from a position along the toner transport path corresponding to the lower end portion of the downstream support portion 134*b* to a position along the toner transport path corresponding to the lower end portion of the upstream support portion 134*a*.

In this manner, the toner T is transported while being circulated along the generally oval toner transport path.

<<<Development of Electrostatic Latent Image>>>

Referring to FIG. 3, the positively charged toner T is transported to the developing position DP. In the vicinity of the developing position DP, the toner T adheres to portions of the electrostatic latent image L1 on the image carrying surface 121*b*1 at which positive charges are lost. That is, the electrostatic latent image LI on the image carrying surface 121*b*1 of the photoconductor drum 121 is developed with the toner T. Thus, an image in the toner T is carried on the image carrying surface 121*b*1.

<<Transfer of Toner Image from Image Carrying Surface to Paper>>

Referring to FIG. 1, as a result of clockwise rotation of the image carrying surface 121*b*1, an image in the toner T which has been carried on the image carrying surface 121*b* of the photoconductor drum 121 as described above is transported toward the transfer position TP. At the transfer position TP, the image in the toner T is transferred from the image carrying surface 121*b*1 onto the paper P.

<<Fixing and Ejection of Paper>>

The paper P onto which an image in the toner T has been transferred at the transfer position TP is sent to the fixing section 170 along the paper path PP. The paper P is nipped between the heating roller 172 and the pressure roller 173, thereby being subjected to pressure and heat. By this procedure, the image in the toner T is fixed on the paper P. Subsequently, the paper P is sent to the paper ejection port 112*a* and is then ejected onto the catch tray 114 through the paper ejection port 112*a*.

<Actions and Effects Achieved by the Structure of the Embodiment>

In the present embodiment, the transport-substrate support member 134 supports the transport wiring substrate 133 such that the transport electrodes 133*b* face the above-described toner transport path formed along the inner wall surface of the developing casing 131, and the first and second margin areas 133*e*1 and 133*e*2, which are regions of the opposite end portions of the transport wiring substrate 133 with respect to the sub-scanning direction (and the toner transport direction) and in which the transport electrodes 133*b* are not formed, are separated from the toner transport path.

Further, the counter wiring substrate 139 having the plurality of counter electrodes 139*a* is supported on the inner wall surface of the developing casing 131 such that the counter wiring substrate 139 faces the transport wiring substrate 133 with a predetermined gap therebetween. The transport-substrate support member 134 supports the transport wiring substrate 133 such that the first and second margin areas 133*e*1 and 133*e*2 are separated from the counter wiring substrate 139. Moreover, the distance between the first and second margin areas 133*e*1 and 133*e*2 and the counter electrodes 139*a* is set to be greater than that between the transport electrodes 133*b* and the counter electrodes 139*a*.

By virtue of these configurations, the first and second margin areas 133*e*1 and 133*e*2, in which no traveling-wave electric field is generated, are separated from the toner transport path. Therefore, the first and second margin areas 133*e*1 and 133*e*2 are prevented, to a possible extent, from hindering transport of the toner T along the toner transport path, which hindrance would otherwise occur because the first and second margin areas 133*e*1 and 133*e*2 face the toner transport path. Accordingly, the toner T can be smoothly transported in the toner transport direction by means of the traveling-wave electric field.

Further, in portions of the toner transport path corresponding to the first and second margin areas 133*e*1 and 133*e*2, the toner T is transported satisfactorily by means of the counter electrodes 139*a*. The transport of the toner T in a circulating state is smoothly performed.

In the present embodiment, the first through fourth electricity feed terminals 133*f*1 to 133*f*4 are provided in the second margin area 133*e*2 of the transport wiring substrate 133.

By virtue of this configuration, toner guide members G (see FIG. 5) for guiding transport of the toner T on the transport wiring substrate 133 can be easily formed outside the region where the toner T is effectively transported by means of the transport electrodes 133*b*. Accordingly, supply of electricity to the plurality of transport electrodes 133*b* provided on the transport wiring substrate 133 and proper transport of the toner T along the toner transport direction can be performed reliably by a simple structure.

In the present embodiment, the transport wiring substrate 133 is engaged with the transport-substrate support member 134 in the first and second margin areas 133*e*1 and 133*e*2. Further, the first and second reinforcement members 133*r*1 and 133*r*2, formed of the same material as the transport electrodes 133*b*, are provided in the first and second margin areas 133*e*1 and 133*e*2.

By virtue of this configuration, the transport wiring substrate 133 is reliably supported on the transport-substrate support member 134 in a predetermined manner.

In the present embodiment, the pulling engagement members 138 are configured such that the pulling engagement members 138 urge the opposite end portions of the second margin area 133*e*2 with respect to the main scanning direction to separate from each other toward the outside with respect to the main scanning direction.

By virtue of this configuration, the portion of the transport wiring substrate 133 where the transport electrodes 133*b* are formed can be supported in a state in which that that portion does not form a wrinkle and is smooth. Therefore, proper transport of the toner T on the transport wiring substrate 133 along the toner transport direction can be performed more reliably by a simple structure.

In the present embodiment, the counter wiring substrate 139 having the plurality of counter electrodes 139*a* arranged along the sub-scanning direction is provided to face the toner electric field transport body 132. By virtue of this configuration, the toner T can be smoothly transported along the gap between the toner electric field transport body 132 and the counter wiring substrate 139.

In the present embodiment, the counter wiring substrate 139 is provided over the substantially entirety of the casing bottom plate 131*b* with respect to the above-described front-rear direction (the sub-scanning direction). By virtue of this configuration, the toner T within the developing casing 131 can be more efficiently transported to a region where the toner electric field transport body 132 and the counter wiring substrate 139 face each other.

<Modifications>

As mentioned previously, the above-described embodiment is a mere example of a typical embodiment of the present invention which the applicant contemplated as the best at the time of filing the present application. The present invention is not limited to the above-described embodiment. Various modifications to the above-described embodiment are possible, so long as the invention is not modified in essence.

Typical modifications will next be exemplified. In the following description of the modifications, members similar in structure and function to those used in the above-described embodiment are denoted by the same reference numerals as those of the above-described embodiment. As for the description of these members, an associated description appearing in the description of the above embodiment can be cited, so long as no technical inconsistencies are involved.

Needless to say, modifications are not limited to those exemplified below. Also, a plurality of the modifications can be combined as appropriate, so long as no technical inconsistencies are involved.

The above-described embodiment and the following modifications should not be construed as limiting the present invention (particularly, those components which partially constitute the means for solving the problems to be solved by the invention and are described operationally and functionally). Such limiting construal unfairly impairs the interests of an applicant (who is motivated to file as quickly as possible under the first-to-file system) while unfairly benefiting imitators, is contrary to the purpose of the patent law which promotes protection and utilization of inventions, and is thus impermissible.

(1) Application of the present invention is not limited to a monochromatic laser printer. For example, the present invention can be preferably applied to so-called electrophotographic image forming apparatus, such as color laser printers and monochromatic and color copying machines.

Also, the present invention can be preferably applied to image forming apparatus of other than the above-mentioned electrophotographic system (for example, toner jet image forming apparatus and ion flow image forming apparatus).

(2) No particular limitation is imposed on the configurations of the electric-field-effected toner transport body 132, the transport wiring substrate 133, and the counter wiring substrate 139 in the above-described embodiment.

For example, the transport electrodes 133*b* can be embedded in the transport-electrode support substrate 133*a* so as not to project from the surface of the transport-electrode support substrate 133*a*. The transport-electrode coating layer 133*c* can be omitted. The transport electrodes 133*b* can be formed directly on the transport-substrate support member 134.

The counter electrodes 139*a* can also be, for example, embedded in the counter-electrode support substrate 139*b* so as not to project from the surface of the counter-electrode support substrate 139*b*. The counter-electrode coating layer 139*c* can be omitted. The counter electrodes 139*a* can be formed directly on the inner wall surface of the developing casing 131.

The longitudinal direction of the transport electrodes 133*b* and the counter electrodes 139*a* is not required to perpendicularly intersect the sub-scanning direction. That is, the longitudinal direction is not required to be parallel with the main scanning direction. Further, the toner transport direction is not required to be parallel with the sub-scanning direction.

(3) The counter wiring substrate 139 may be omitted partially or entirely.

Figure 7:
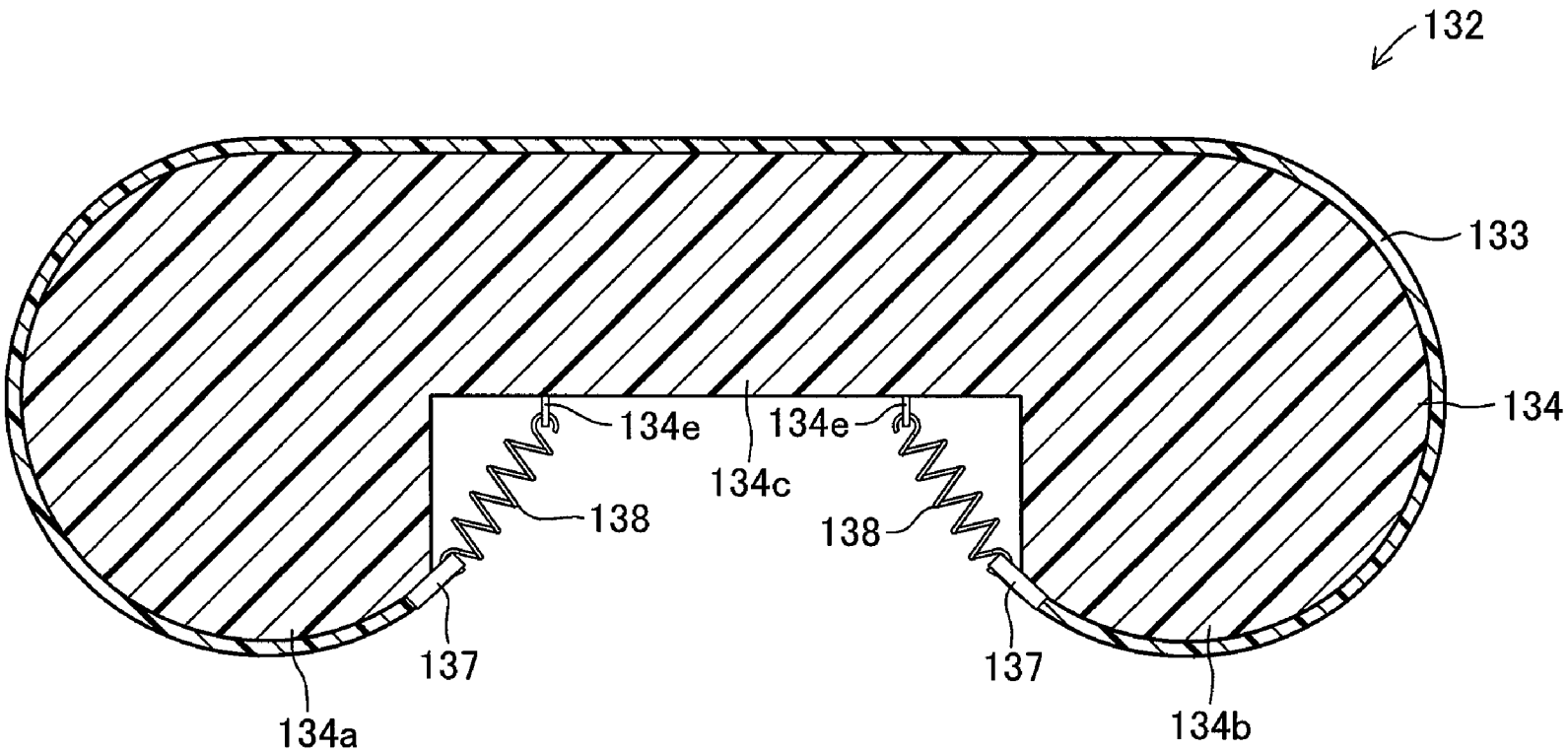
FIG. 7 is a side sectional view showing the structure of one modification of a developer electric field transport body shown in FIG. 2.
Figure 8:
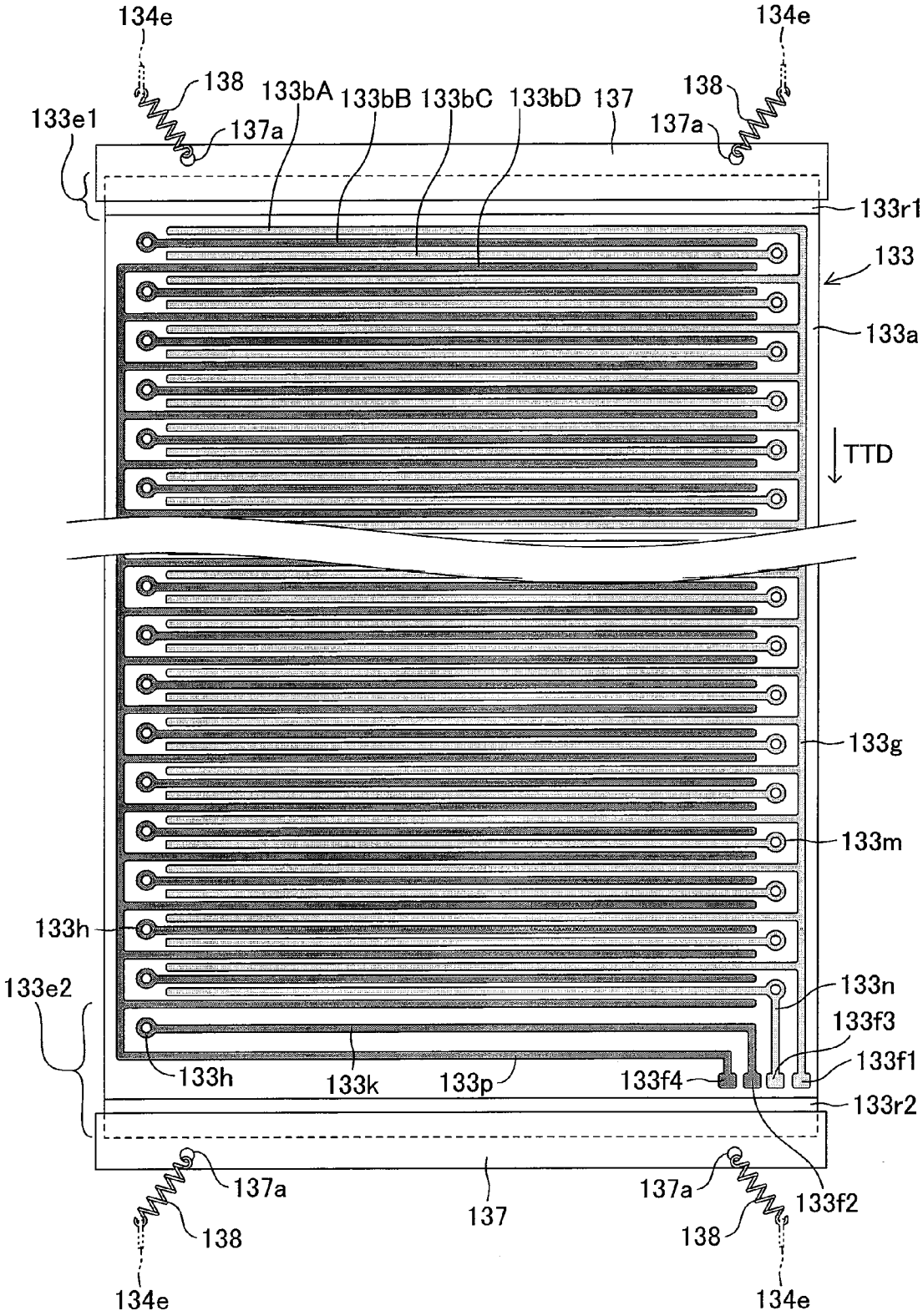
FIG. 8 is a plan view of a transport wiring substrate shown in FIG. 7.

(4) FIG. 7 is a side sectional view showing the structure of one modification of the toner electric field transport body 132 shown in FIG. 2. FIG. 8 is a plan view of the transport wiring substrate 133 shown in FIG. 7.

As shown in FIG. 7, the opposite end portions of the transport wiring substrate 133 with respect to the toner transport direction may be engaged with the transport-substrate support member 134 via engagement portions 137 and pulling engagement members 138. That is, the first margin area 133*e*1 and the second margin area 133*e*2 may be fixed to different engagement portions 137, respectively; and the engagement portions 137 may be engaged with the transport-substrate support member 134 via the corresponding pulling engagement members 138.

Figure 9:
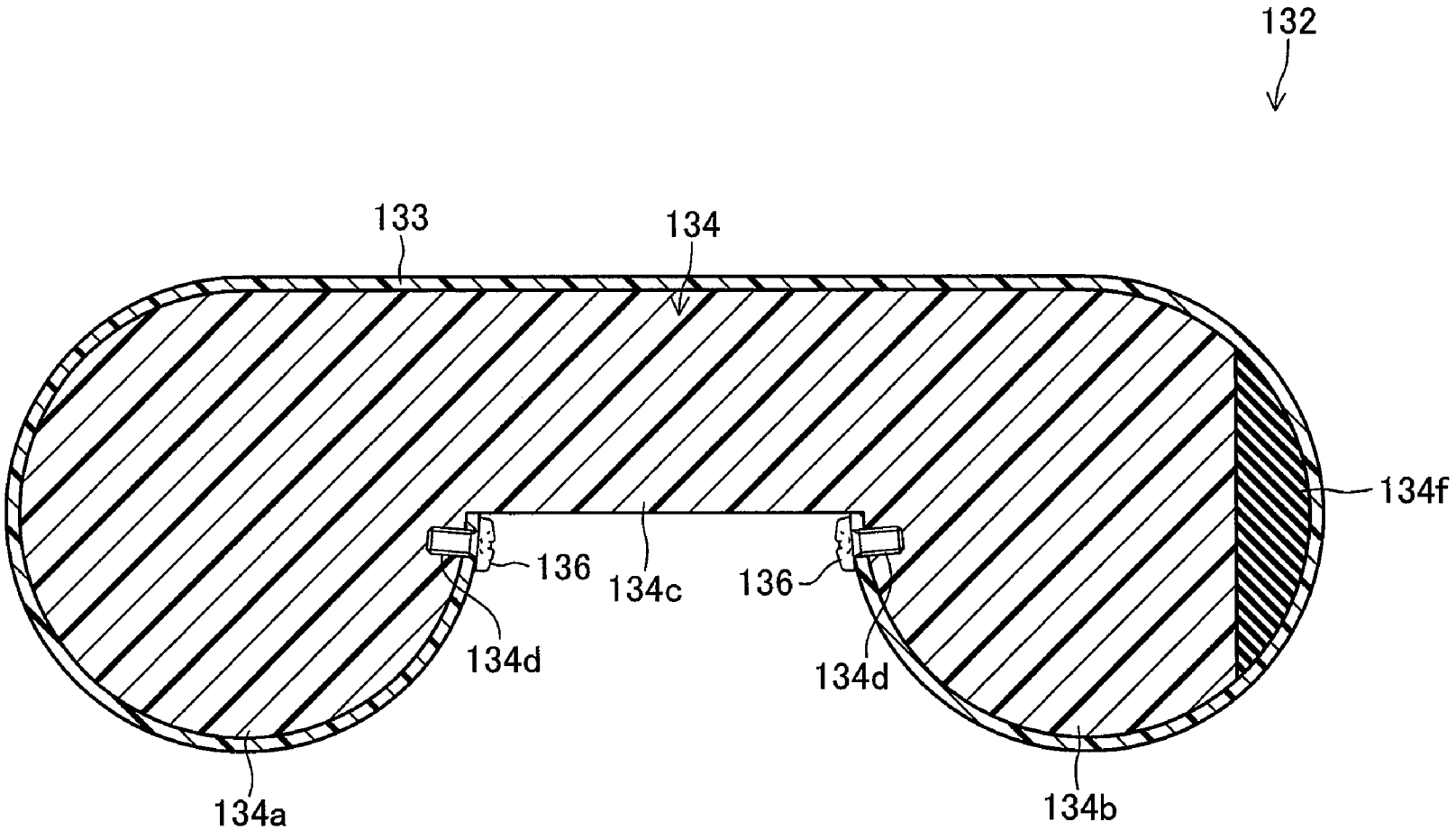
FIG. 9 is a side sectional view showing the structure of another modification of the developer electric field transport body shown in FIG. 2.

(5) FIG. 9 is a side sectional view showing the structure of another modification of the toner electric field transport body 132 shown in FIG. 2.

As shown in FIG. 9, a tension imparting portion 134*f* having elasticity may be provided on the downstream support portion 134*b* of the transport-substrate support member 134. The tension imparting portion 134*f* may be made of rubber, sponge, or the like. In this case, the opposite end portions of the transport wiring substrate 133 with respect to the toner transport direction are fixed by use of the fixing bolts 136.

By virtue of this configuration, the transport-substrate support member 134 itself can be configured such that it imparts a tension to the transport wiring substrate 133. Therefore, the structure which can impart a proper tension to the transport wiring substrate 133 can be realized simply.

Notably, in this case, the structure which can impart a proper tension to the transport wiring substrate 133 without generating a wrinkle in the transport wiring substrate 133, can be realized simply by means of changing the elasticity (rubber hardness, sponge hardness, or the like) of the tension imparting portion 134*f* such that an elasticity distribution is produced along the main scanning direction.

(6) The entirety of the transport-substrate support member 134 may be formed of an elastic material such as rubber, sponge, or the like.

(7) As shown in FIG. 9, the fixing member 135 (see FIGS. 2 and 5) can be omitted when the thickness and mechanical strength of the transport-electrode support substrate 133*a* are properly set. This is the same with the engagement portion 137 shown in FIGS. 2, 5, and 8.

Figure 10:
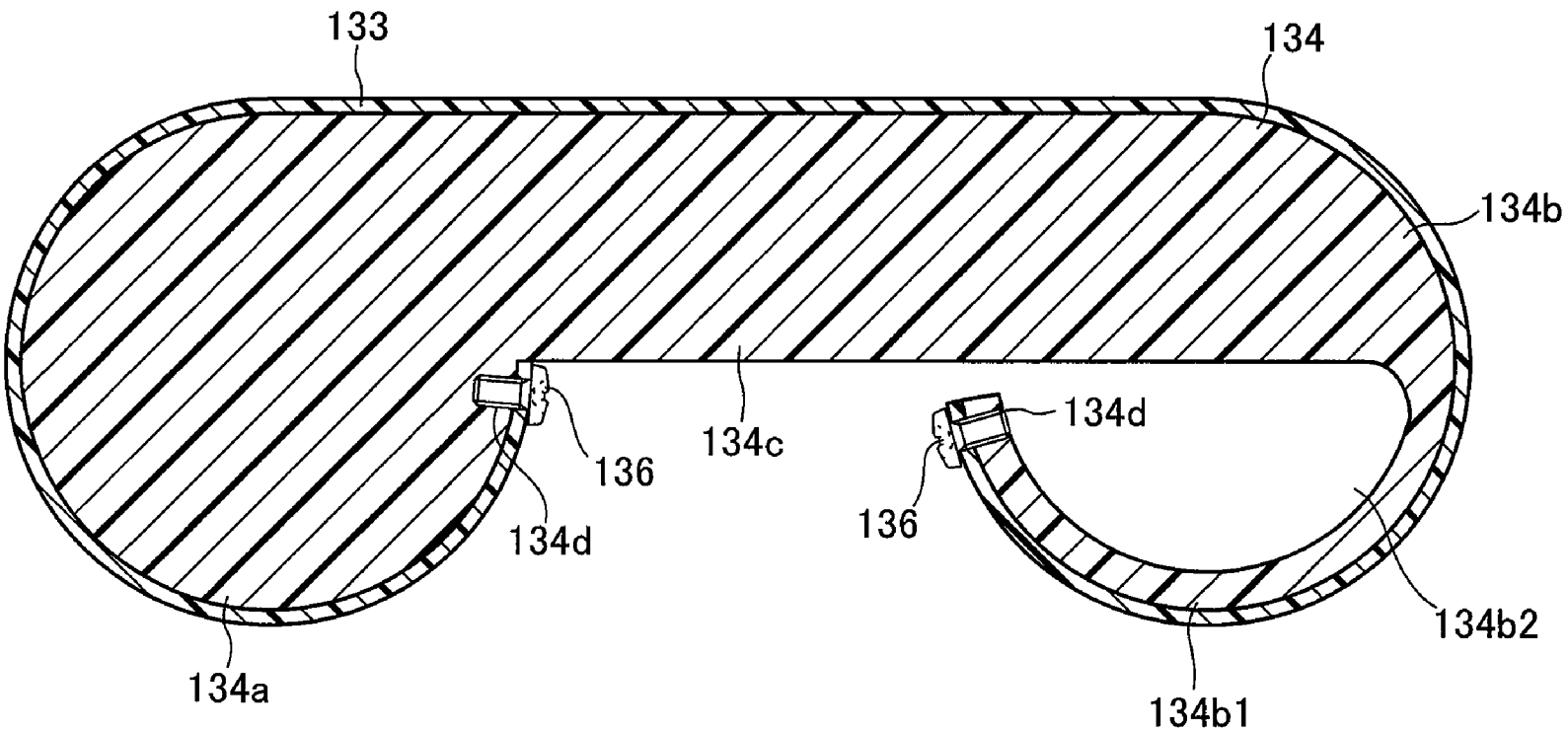
FIG. 10 is a side sectional view showing the structure of another modification of the developer electric field transport body shown in FIG. 2.

(8) FIG. 10 is a side sectional view showing the structure of another modification of the toner electric field transport body 132 shown in FIG. 2.

As shown in FIG. 10, a plate spring portion 134*b*1 having the form of a thin plate may be formed at the lower end portion of the downstream support portion 134*b* of the transport-substrate support member 134. That is, a cavity 134*b*2 may be formed between an upper portion of the downstream support portion 134*b* and the plate spring portion 134*b*1 so as to enable the plate spring portion 134*b*1 to elastically deform toward the cavity 134*b*2 side.

In this case, the downstream end portion of the transport wiring substrate 133 with respect to the toner transport direction is fixed by means of screw holes 134*d* formed in a free end portion of the plate spring portion 134*b*1 and fixing bolts 136. That is, the opposite end portions of the transport wiring substrate 133 with respect to the toner transport direction are fixed by use of the fixing bolts 136.

By virtue of this configuration, the transport-substrate support member 134 (the downstream support portion 134*b*) itself can be configured such that it imparts a tension to the transport wiring substrate 133. Therefore, the structure which can impart a proper tension to the transport wiring substrate 133 can be realized simply.

Figure 11:
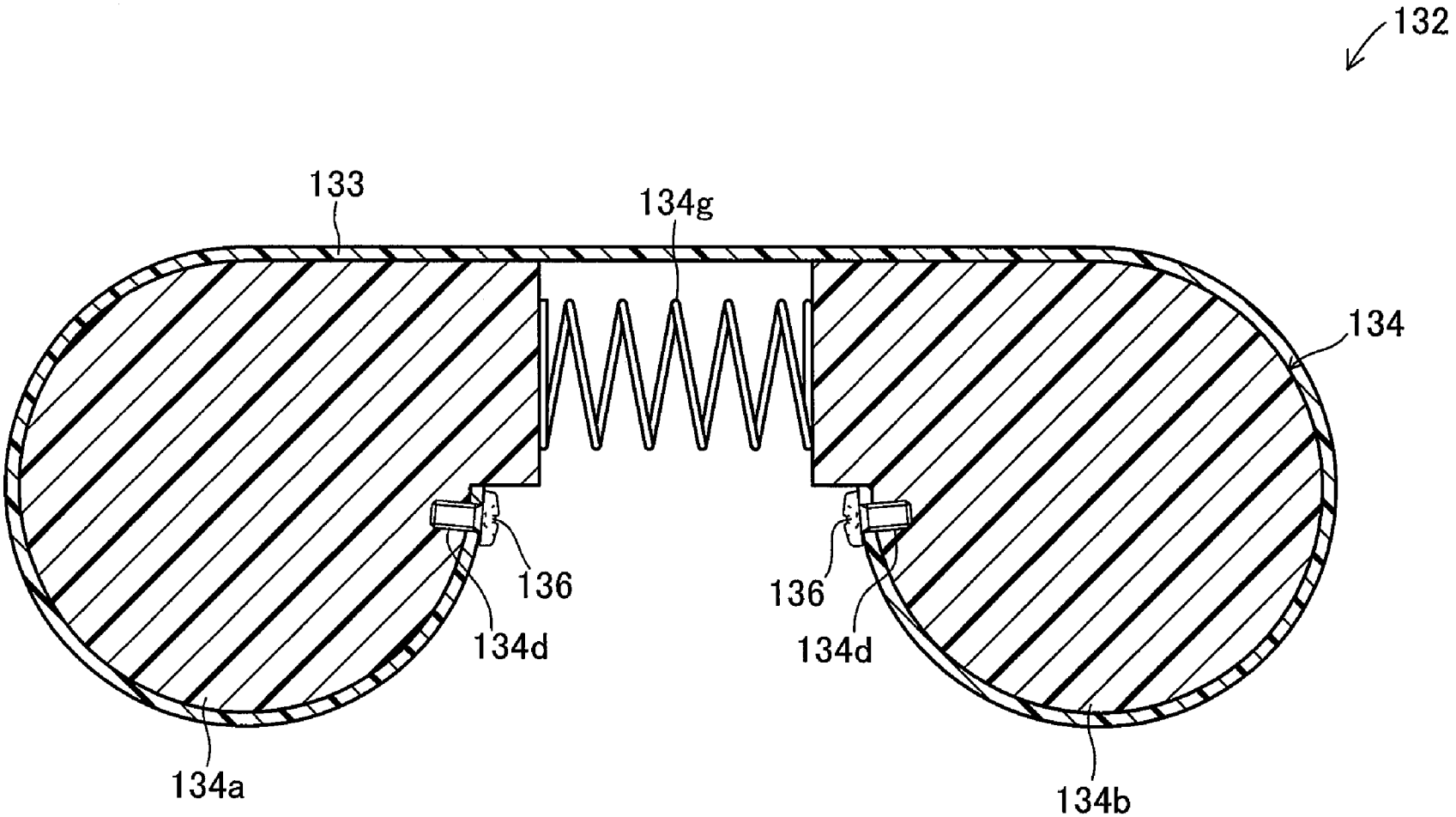
FIG. 11 is a side sectional view showing the structure of another modification of the developer electric field transport body shown in FIG. 2.

(9) FIG. 11 is a side sectional view showing the structure of another modification of the toner electric field transport body 132 shown in FIG. 2.

As shown in FIG. 11, the upstream support portion 134*a* and the downstream support portion 134*b* are formed as separate members; and a tension imparting portion 134*g* urges the two portions to separate from each other. The tension imparting portion 134*g* may be formed of an elastic member such as a coil spring or a rubber. In this case, the opposite end portions of the transport wiring substrate 133 with respect to the toner transport direction are fixed by use of the fixing bolts 136.

Notably, as shown in FIG. 11, the tension imparting portion 134*g* may be interposed between the upstream support portion 134*a* and the downstream support portion 134*b*. Alternatively, the tension imparting portion 134*g* may be configured to urge the upstream support portion 134*a* only to move to the rear side (left side in FIG. 11). Alternatively, the tension imparting portion 134*g* may be configured to urge the downstream support portion 134*b* only to move to the front side (right side in FIG. 11).

(10) The shapes of the outer circumferential surfaces of the upstream support portion 134*a* and the downstream support portion 134*b* are not limited to a cylindrical shape. For example, the outer circumferential surfaces may assume a so-called crown shape such that each outer circumferential surface has a convex portion at the center thereof with respect to the main scanning direction.

(11) Grease may be charged into the space between the transport wiring substrate 133 and the transport-substrate support member 134. The grease prevents the transport wiring substrate 133 from lifting from the transport-substrate support member 134.

(12) Those component elements which partially constitute the means for solving the problems to be solved by the invention and are described operationally and functionally include not only the specific structures disclosed in the above-described embodiment and modifications but also any other structures that can implement the operations and functions of the elements.

The invention claimed is:

1. An image forming apparatus comprising:

an electrostatic latent-image carrying body which has a latent-image forming surface formed in parallel with a predetermined main scanning direction and configured such that an electrostatic latent image in the form of an electric potential distribution is formed thereon, and which is configured such that the latent-image forming surface can move along a sub-scanning direction orthogonal to the main scanning direction; and a developer supply apparatus disposed to face the electrostatic latent-image carrying body, and configured to supply a developer in the form of fine particles onto the latent-image forming surface in a state in which the developer is charged, wherein the developer supply apparatus includes:

a developer containing casing configured to be able to contain the developer therein and which includes an opening portion at a position facing the electrostatic latent-image carrying body;

a plurality of transport electrodes arranged along the sub-scanning direction such that their longitudinal direction intersects with the sub-scanning direction, the transport electrodes being capable of transporting the developer in a predetermined developer transport direction when a traveling-wave voltage is applied to the transport electrodes;

a flexible insulating substrate on which the transport electrodes are provided along the sub-scanning direction between margin areas, which are end portions thereof with respect to the sub-scanning direction, and which is accommodated within the developer containing casing such that a predetermined gap is formed between the insulating substrate and an inner wall surface of the developer containing casing;

a substrate support member located in the developer containing casing, the substrate support member including an external surface extending in the main scanning direction and supporting the insulating substrate thereon in such a manner that the transport electrodes face the latent-image forming surface via the opening portion with a predetermined developing gap formed therebetween; and means for tensilely and elastically fixing the insulating substrate to the substrate support member in such a manner as to impart a predetermined tension along the sub-scanning direction to the insulating substrate, wherein the means for tensilely and elastically fixing the insulating substrate to the substrate support member is attached to the substrate support member.

2. An image forming apparatus according to claim 1, further comprising a plurality of counter electrodes, which are supported on the inner wall surface of the developer containing casing and are provided in parallel with the transport electrodes such that the counter electrodes face the transport electrodes with the predetermined gap separating the counter electrodes and the transport electrodes, wherein the insulating substrate is supported by the substrate support member such that the margin areas are separated from the counter electrodes.

3. An image forming apparatus according to claim 2, wherein the insulating substrate is supported by the substrate support member such that the distance between the margin areas and the counter electrodes becomes greater than that between the transport electrodes and the counter electrodes.

4. An image forming apparatus according to claim 1, further comprising electricity feed terminals provided on the insulating substrate so as to feed electricity to the transport electrodes, wherein the electricity feed terminals are provided in the margin areas of the insulating substrate.

5. An image forming apparatus according to claim 1, wherein the insulating substrate is engaged with the substrate support member in the margin areas.

6. An image forming apparatus according to claim 1, wherein the tensilely and elastically fixing means comprises:

a fixing member configured to fix a first margin area of the insulating substrate, which is one part of the margin area at one end of the insulating substrate with respect to the sub-scanning direction, to the substrate support member, and a pulling engagement member configured to engage a second margin area of the insulating substrate, which is the other part of the margin area at the other end of the insulating substrate with respect to the sub-scanning direction, with the substrate support member such that the pulling engagement member urges the second margin area in a direction for imparting a tension to the insulating substrate.

7. An image forming apparatus according to claim 6, wherein the pulling engagement member is configured to urge opposite end portions of the second margin areas with respect to the main scanning direction so as to separate the opposite end portions from each other to the outside with respect to the main scanning direction.

8. An image forming apparatus according to claim 6, further comprising reinforcement members which are provided in the margin areas and are formed of the same material as the transport electrodes.

9. An image forming apparatus according to claim 1, wherein the insulating substrate is supported by the substrate support member such that the transport electrodes face a developer transport path formed along the inner wall surface of the developer containing casing, and the margin areas of the insulating substrate are separated from the developer transport path.

10. A developer electric field transport apparatus configured to transport a charged developer in the form of fine particles along a predetermined developer transport direction by means of an electric field, the developer electric field transport apparatus comprising:

a plurality of transport electrodes arranged along a moving direction of a developer carrying body having a developer carrying surface which carries a thin layer of the developer, the transport electrodes being configured such that their longitudinal direction intersects with the moving direction, and the transport electrodes can transport the developer in the predetermined developer transport direction when a traveling-wave voltage is applied to the transport electrodes;

a flexible insulating substrate on which the transport electrodes are provided along the moving direction between margin areas which are end portions thereof with respect to the moving direction;

a substrate support member including an external surface extending in a main scanning direction and supporting the insulating substrate thereon; and means for tensilely and elastically fixing the insulating substrate to the substrate support member in such a manner as to impart a predetermined tension along a direction perpendicular to the main scanning direction to the insulating substrate, wherein the means for tensilely and elastically fixing the insulating substrate to the substrate support member is attached to the substrate support member.

11. A developer electric field transport apparatus according to claim 10, wherein the tensilely and elastically fixing means comprises:

a fixing member configured to fix a first margin area of the insulating substrate, which is one part of the margin area at one end of the insulating substrate with respect to the moving direction, to the substrate support member, and a pulling engagement member configured to engage a second margin area of the insulating substrate, which is the other part of the margin area at the other end of the insulating substrate with respect to the moving direction, with the substrate support member such that the pulling engagement member urges the second margin area in a direction for imparting a tension to the insulating substrate.

12. A developer electric field transport apparatus according to claim 11, wherein the pulling engagement member is configured to urge opposite end portions of the second margin areas with respect to the longitudinal direction so as to separate the opposite end portions from each other to the outside with respect to the longitudinal direction.

13. A developer electric field transport apparatus according to claim 11, further comprising reinforcement members which are provided in the margin areas and are formed of the same material as the transport electrodes.

14. A developer electric field transport apparatus according to claim 10, further comprising electricity feed terminals provided on the insulating substrate so as to feed electricity to the transport electrodes, wherein the electricity feed terminals are provided in the margin areas of the insulating substrate.

15. A developer electric field transport apparatus according to claim 10, wherein the margin areas of the insulating substrate are engaged with the substrate support member so as to be separated from a developer transport path formed along an area of the insulating substrate in which the transport electrodes are formed.

* * * * *